US011602772B1

(12) United States Patent
Lefas et al.

(10) Patent No.: US 11,602,772 B1
(45) Date of Patent: Mar. 14, 2023

(54) AIR COOLED SIFTING DEVICE

(71) Applicant: ORENDA AUTOMATION TECHNOLOGIES INC., Markham (CA)

(72) Inventors: Hristos Lefas, Toronto (CA); Malcolm Lawrence Baird, Crestmead (AU)

(73) Assignee: ORENDA AUTOMATION TECHNOLOGIES, INC.

( * ) Notice: Subject to any disclaimer, the term of this patent is extended or adjusted under 35 U.S.C. 154(b) by 0 days.

(21) Appl. No.: 17/490,169

(22) Filed: Sep. 30, 2021

(51) Int. Cl.
*B07B 1/46* (2006.01)

(52) U.S. Cl.
CPC ..... *B07B 1/46* (2013.01); *B07B 1/4645* (2013.01); *B07B 2201/04* (2013.01)

(58) Field of Classification Search
CPC ..... B07B 1/46; B07B 1/4645; B07B 1/4663; B07B 2201/04; B07B 7/06; B07B 7/08; B07B 7/10
USPC ..... 209/355
See application file for complete search history.

(56) References Cited

U.S. PATENT DOCUMENTS 1,430,636 A * 10/1922 Forgeson ..... A47J 43/22 209/357
3,315,807 A * 4/1967 Rosen ..... A63H 33/32 209/337
4,946,044 A * 8/1990 Havrilla ..... B03B 4/02 209/477
6,216,875 B1 * 4/2001 Stone ..... B07B 1/06 209/152
10,413,943 B2 * 9/2019 Vasanthan ..... B07B 4/08
2009/0277818 A1 * 11/2009 Stachura ..... F26B 17/006 209/252
2016/0184866 A1 * 6/2016 Iwamatsu ..... B07B 1/469 241/15

FOREIGN PATENT DOCUMENTS

CN 207546974 6/2018
EP 0084666 A1 * 8/1983
JP 2012055788 3/2012
WO WO-2010045284 A1 * 4/2010 ..... B07B 1/38

OTHER PUBLICATIONS

International Search Report and Written Opinion dated Oct. 27, 2022 issued in corresponding International Application No. PCT/CA2022/000031.

* cited by examiner

*Primary Examiner* — Gene O Crawford
*Assistant Examiner* — Muhammad Awais
(74) *Attorney, Agent, or Firm* — Onello & Mello, LLP

(57) ABSTRACT

A sifter insert for use in a sifting device has an insert frame and a screening media affixed thereto. An insert frame air channel is located within the insert frame. The sifter insert is sized to be received in a sifter box frame of an associated sifter box. The sifter box frame has a box frame air channel in fluid communication with the insert box frame channel of the received sifter insert. The passage of air through the box frame air channel and the insert frame air channel may cool the sifter box and the insert frame, and, may cool the screening media and the material being sifted thereon. Channel holes in the inset frame may direct air from the insert frame air channel to the screening surface of the screening media.

29 Claims, 14 Drawing Sheets

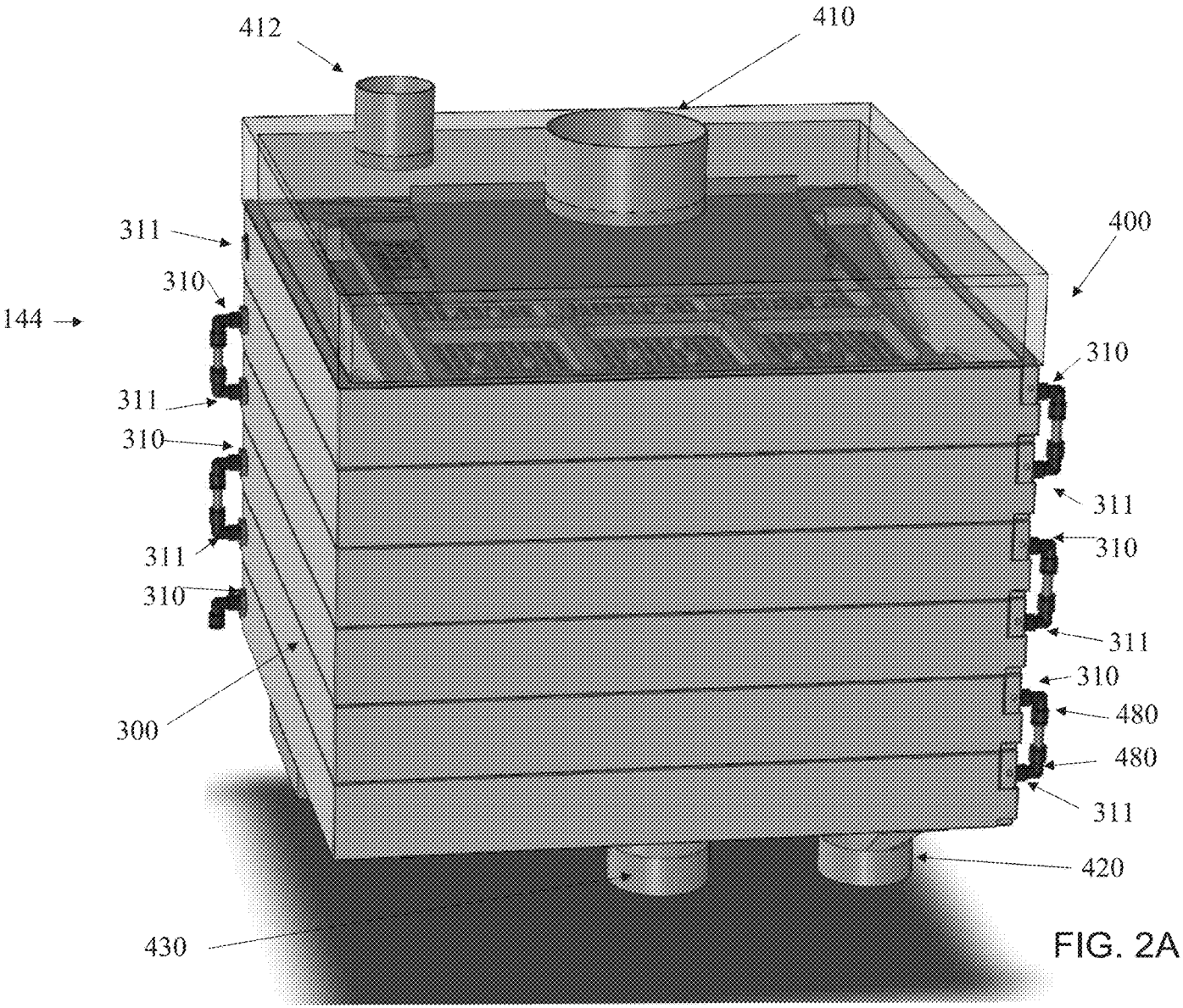
400
410
412
310
311
310
311
310
311

AIR COOLED SIFTING DEVICE

FIELD OF THE INVENTION

This invention relates to a sifting device used to separate particles based on size and/or shape through screens. More particularly, this invention relates to a sifting device which is air cooled.

BACKGROUND OF THE INVENTION

In the past, sifting devices have been used to sort particles according to size, such as diameter, and/or shape. Typically, a sifter will have one or more screens, or screening media, and the particles to be sorted will come into contact with these screening media. Particles of a desired size and/or shape will be able to flow through the screening media, and, particles that are coarse, or "oversized" will not be able to flow through the screening media. In this way, sifting devices facilitate sorting and classification of particles based on size and/or shape.

Sifting devices have been used in the past in association with reducing apparatuses comprising pulverising or grinding machines to determine if the particles have been sufficiently pulverised to the desired particle size. Particles that have been sufficiently pulverised to the desired particle size will typically pass or flow through the screens of the sifter inserts and will be considered as the finished material. Particles which are too coarse or "oversized" because they have not been sufficiently pulverised to the desired or finished particle size, will not pass or flow through the screening media of the sifting device and, rather, will be discarded or, more likely, reintroduced to the pulverising or grinding machines to be further processed.

In the past, when sifting devices have been associated with a reducing apparatus, typically the reduced material would emanate directly from a pulverising or grinding machine of the reducing apparatus to the sifting device for separation of the finished material from oversized material. In such circumstances, however, the reduced particles emanating directly from the pulverising or grinding machine may be at an elevated temperature (such as about 80° C.-110° C.) which can cause several difficulties. First, the particles could melt with each other such as by agglomerating or melting together, decreasing the effectiveness of the reducing apparatus and requiring the agglomerated materials to be reintroduced for further processing. Furthermore, because the particles may be at an elevated temperature when emanating from the pulverising or grinding machine, they may have thermally expanded which would cause them to have a temporarily larger size due to the thermal expansion at their elevated temperature. In this case, the prior art sifting devices would effectively be determining if the particles have the desired particle size to pass through the screening media at an elevated temperature rather than at an operational temperature, such as room temperature, thereby creating inherent inaccuracies in the sorting and classification process of the sifting device.

Furthermore, prior art sifting devices have had screen inserts with screening media made of metal and frames made of wood, or in some cases, frames made of metal. This has been done in many cases to prevent excessive relative thermal expansion between the frames of the screen inserts and the metal screening media having been affixed thereto. In particular, the relative thermal expansion of the screening media and the frames of the screen inserts to which the metal screening media has been affixed could adversely mechanically deform the metal screening media over time. Because of this, plastics have been rarely used in association with metal screening media such as frames for screen inserts, because the elevated temperatures may cause the plastic components to thermally expand differently than the metal screening media, thereby causing potential deformation of the screen inserts, and, in particular the metal screening media over time.

Furthermore, wooden frames for screen inserts may suffer from several disadvantages, including the fact that they may become contaminated over time, particularly when used with food products. Furthermore, the wood used in the prior art wooden frames of screen inserts could splinter causing contamination of the finished material. Furthermore, while wood has been known to be relatively sturdy and have a low thermal expansion coefficient, wood typically cannot be easily cleaned, such as by power washing, as may occur for instance when there is a change in the material to be sifted through the sifting device. Also, the prior art sifting devices which have sifter boxes with frames made of wood and/or screen inserts with frames made of wood can be more costly to produce as each wooden component of the screen insert would need to be carefully measured and assembled.

Accordingly, there are several disadvantages in the prior art devices which have affected the overall efficiency of the prior art sifting devices. Furthermore, the prior art sifting devices do not address the disadvantages arising from material being sifted at elevated temperatures, such as if they have recently been expelled from a reducing apparatus comprising a pulverising or grinding machine.

SUMMARY OF THE INVENTION

Accordingly, it is an object of this invention to at least partially overcome some of the disadvantages of the prior art. Also, it is an object of this invention to provide a sifting device to separate finished material from non-finished material, said sifting device comprising: a screening media having a plurality of openings for separating finished material from non-finished material; a sifter box associated with the screening media, said sifter box having a sifter box frame: a box frame air channel located within the sifter box frame, said box frame air channel having a box air inlet for receiving air therein and a box air outlet for expelling air that has passed through at least a portion of the box frame air channel; wherein air passing through the box frame air channel cools the sifter box and the associated screening media.

In a further aspect, the present invention resides in a sifter box for use in a sifting device, said sifting device separating finished material from non-finished material, said sifter box comprising: a sifter box frame associated with a screening media for separating finished material from non-finished material; a box frame air channel located within the box frame, said box frame air channel having a box air inlet for receiving air therein and a box air outlet for expelling air that has passed through at least a portion of the box frame air channel; wherein the passage of air through the box frame air channel cools the sifter box.

In a still further aspect, the present invention resides in a screen insert for use with a sifter box of a sifting device, said sifting device separating finished material from non-finished material, said screen insert comprising: an insert frame sized and shaped to be received by a sifter box frame of the sifter box; a screening media affixed to the insert frame, the screening media having a plurality of openings sized to permit passage of finished material and prevent passage of non-finished material; an insert frame air channel located within the insert frame, said insert frame air channel having an insert air intake for receiving air therein, said air passing through at least a portion of the insert frame air channel; wherein the passage of air through the insert frame air channel causes heat transfer between the air and the screening media affixed to the insert frame.

Accordingly, in at least one preferred embodiment, the present invention provides for an air cooled sifting device. This is accomplished, in at least one preferred aspect, by having a box frame air channel located within the sifter box frame with a box air inlet for receiving air therein and a box air outlet for expelling air that has passed through at least a portion of the box frame air channel. In this way, the sifter box, as well as the screening element associated therewith, may be cooled to avoid undesired and/or unintended heating and thermal expansion and/or thermal distortion, which may be caused, for example, in one embodiment, when the material being sifted is reduced material emanating directly from a reducing apparatus comprising a pulverising or grinding machine and, therefore, may be at an elevated temperature.

A further advantage of at least some embodiments of the present invention is that cooling of the sifter box also transfers heat between the screening media and the air passing through the box frame air channel. In this way, if the screening media is at an elevated temperature, such as due to sifting heated material that has recently emanated from a reducing apparatus, air passing through the box frame air channel may also cool the screening media, and, by extension, may also cool the heated input material being sifted. Accordingly, by transferring heat from the screening media to air passing through the box frame air channel of the sifter box, the material being sifted may also be cooled thereby decreasing the likelihood of agglomeration or melting of the reduced materials together, as well as providing a more accurate classification of the finished material at room temperature, or other temperature for the finished material to be used. Accordingly, accuracy of the sifting process, as well as the efficiency of the sifting process, is thereby increased by transferring heat from the screening media, to the air passing through the box frame air channel of the sifter box.

In a further aspect, air passing in the box frame air channel also cools the sifting device as a whole. This provides for more efficient handling of the material to be sifted as well as assisting with maintaining the overall sifting device at a lower nominal temperature. This is particularly true where all of the sifter boxes used in a sifting device have a box frame air channel according to the present invention, as opposed to only one or two such sifter boxes. Furthermore, to increase the cooling efficiency of the sifting device as a whole, in one embodiment, the coolest air is in contact with the first screening media that the material contacts in the sifting device. In this way, the coolest air entering the sifting device would pass through the box frame air channel of the sifter box associated with the first screening media that the material contacts, which would typically provide the highest temperature differential between the air passing through the box frame air channel and the material being sifted on the screening media. This larger temperature differential ($\Delta T$) increases the heat transfer from the screening media to the air passing through the box frame air channel of the first sifter box in the material flow path.

In another embodiment, air exiting the box air outlet of the first sifter box would then be fluidly connected to the adjacent air inlet of the adjacent or second sifter box in the direction of the material travel in the sifting device. In this way, again, the maximum temperature differential $\Delta T$ for the adjacent or second screening media in the downstream direction of material travel would be present to have the greatest heat transfer.

In cases where more than two sifter boxes are present, a similar flow of air could occur from the outlet of one sifter box to the inlet of the adjacent sifter box. The final sifter box in the sifting device would then have an air outlet to expel the air that has passed through at least a portion of all of the box frame air channels of the box fames in the sifting device and potentially to an external location.

It is understood that there could be a different number of sifter boxes holding associated screening media in order to screen the material to the described degree. The additional sifter boxes, and corresponding associated screening media, will increase the amount of material that may contact the screening element and, therefore, be correctly classified. While there is no set number of sifter boxes that could be present in the sifting device, typically there would be anywhere from 2 to 15 sifter boxes, each holding a corresponding associated screening media, in a typical sifting device.

In a further preferred embodiment, the air passing through the box frame air channel may be provided through suction or negative pressure at the air outlet of the box air frame channel of the last sifter box, or, by blowing or positive air pressure, such as blowing air into the box air frame channel of one of the sifter boxes of the sifting device. In some embodiments, suction or negative pressure is preferred so as to more easily draw cooler air through the box frame air channels of the sifter boxes rather than blowing air from a blower which may have been inadvertently heated. In a further preferred embodiment, in cases where the sifting device forms part of a reducing apparatus, a common air source or vacuum used for the reducing apparatus, or other types of apparatuses, could also be used to create a vacuum for the sifting device and, therefore, draw air through the box frame air channels of the sifter boxes.

In a further preferred embodiment, the sifting device may comprise a sifter insert having an insert frame to which the screening media may generally be affixed. The sifter insert is sized and shaped to be received within the sifter box. In this way, different screen inserts can be easily interchanged into the sifter box frame. In a preferred embodiment, the insert frame comprises an insert frame air channel in fluid communication with the box frame air channel when the screen insert has been received by the sifter box frame such that a portion of the air passing through the box air frame channel may also pass through the insert frame air channel thereby further cooling the insert frame and the screening media affixed thereto as well as the material being classified.

An advantage of a further preferred embodiment includes the insert frame air channel comprising an internal cooling surface defined by a screen/channel interface wall in thermal contact with the screening media. In this way, the screen/channel interface wall may have a potentially high thermal conductivity, such as by having thermal fins or a different composition or thickness, to facilitate heat transfer between the screening media and the air passing in the insert frame air channel. In one preferred embodiment, the screening media may be attached to or through the screen/channel interface wall and have portions extending through or into the insert frame air channel to facilitate heat transfer between the screening media and the air passing in the insert frame air channel. Typically, however the screening media may be affixed to the insert frame by an adhesive, such as melted glue, or by mechanical means, such as staples.

A further advantage of at least one preferred embodiment relates to a wall of the insert frame air channel, such as the screen/channel interface wall, or another wall, also comprising a plurality of channel holes or sprinklers in fluid communication with the insert frame air channel. The plurality of channel holes or sprinklers are oriented to direct air to the screening surface of the screening media. In a preferred embodiment, the channel holes or sprinklers may be oriented parallel to the screening surface of the screening media to direct air across the screening surface of the screening media. In a further preferred embodiment, the channel holes are oriented on a slanted wall of the insert frame, said slanted wall being at an acute angle to the screening surface of the screening media to direct air emanating from the channel holes towards the screening media being held by the screen insert. In this way, the plurality of channel holes may act as an insert air output of the insert frame air channel to direct air passing in the insert air frame channel out towards the screening media. In this preferred embodiment, the air passing through a portion of the insert frame air channel may also pass over or towards the screen surface of the screening media. This further facilitates cooling of the material being sifted on the screen surface of the screening media. In addition, the air passing through the plurality of channel holes may also interact with the material being sifted on the screen surface of the screening media to facilitate sifting of the particles through the screening media. In this preferred embodiment, it is preferable if the air passing through the insert frame air channel is provided through positive air pressure, such as a blower fan, rather than a negative air pressure or suction, to facilitate air passing through the plurality of channel holes. Also, negative pressure could cause material associated with the screening media to enter into one of the channel holes causing blockages. Typically, the fan or blower would have air flow in the range of 20 to 30 CFM.

An advantage of a further preferred embodiment includes permitting the use of materials for the screening media, the insert frame of the screen insert and the sifter box that may have different thermal expansion coefficients. In particular, if the insert frame of the screen insert and the screening media are cooled so as to avoid elevated temperatures, differing relative rates of thermal expansion of the components, which could cause one of the components to expand at a different rate and potentially damage the other component, is decreased. In particular, in a preferred embodiment, the insert frame of the screen insert may be made from a plastic material and the screening media may be made from a metal material. Furthermore, the sifter box may also be made of plastic. By passing air through the insert frame air channel and/or box frame air channel, relative thermal expansion of an insert frame of the screen insert made of plastic and a screening media made of metal is decreased thereby permitting a wider variety of materials to potentially be used for the components of the sifter insert and, in particular, the insert frame. Likewise, by passing air through the insert frame air channel and/or the box frame air channel, relative thermal expansion between the sifter box and the insert frame may be decreased thereby permitting a wider variety of materials to be used for the insert frame and the sifter box.

Furthermore, in the embodiment where the insert frame of the screen insert and/or sifter box are made of plastic, as opposed to other materials such as wood and/or metal, there is also a potential decrease in the cost of manufacture. In this way, providing the ability to use different types of material for the screening media, the insert frame of the screen insert and/or the sifter box that have different thermal expansion coefficients, and in particular plastic or other types of polymer materials with screening media made of metal, may decrease the cost of manufacture of these components.

In a further preferred embodiment, the sifter box of the present invention is reverse compatible with prior art screen inserts having wooden frames. In other words, while in some preferred embodiments the screen insert has an insert frame with an insert frame air channel, it is understood that the invention contemplates having a sifter box with a box frame air channel and a wooden frame of a screen insert without any insert frame air channel. It is understood that in this case, the heat transfer may not be as efficient. Nevertheless, it is understood that the sifter boxes of the present invention may be reverse compatible with prior art wooden insert frames so that the prior art wooden insert frames can continue to be used with sifter boxes having a box frame air channel. In such an embodiment, the sifter box may not have a screen/box air outtake as there would be no corresponding intake in a wooden frame of a prior art screen insert to direct air from the box frame air channel. Alternatively, if the sifter box has a screen/box air outtake, then it may either be plugged or, if the wooden frame of the screen insert is sufficiently compressed, the wooden frame of the prior art screen insert could block such screen/box air outtake from the box frame air channel.

In a preferred embodiment, where the sifter box and the insert frame of the screen insert are made from plastic, power washing becomes possible which would be difficult in the case of a sifter box or an insert frame made from wood. By power washing insert frames made of plastic material, the time to change screening inserts in a sifting device, as would be required for instance if the size of the material being sifted changes or if the type of material being sifted changes, would be reduced by permitting power washing of the insert frames made of a plastic material. In other words, insert frames made of metal and plastic are easier to clean and less expensive to use at least for this reason.

A further advantage of at least some embodiments of the present invention with insert frames made of plastic material and/or sifter boxes made of plastic material, is that the plastic may be more durable than prior art insert frames made from wood or sifter boxes made from wood. This increased durability makes the corresponding plastic sifter boxes and plastic insert frames more robust decreasing the cost of use by decreasing potential damage during handling of these components. Furthermore, at the end of life of insert frames made of plastic material and/or sifter boxes made of plastic material, these plastic components can themselves be recycled thereby decreasing the impact on the environment. Furthermore, if the sifting device is used as part of a reducing apparatus, the plastic components, whether the sifter box and/or insert frame of the screen insert, could themselves be reduced in the reducing apparatus to facilitate recycling thereof.

In a further preferred embodiment, where the insert frame of the screen insert is made of plastic, it is further preferred that the plastic is selected to be food grade plastic, including low linear density polyethylene (LLDPE) or other suitable food grade plastic materials. In this way, a screen insert having an insert frame made of LLDPE plastic and screening media made of metal could be used in a sifting device for sifting food. Furthermore, use of an insert frame made of plastic, and in particular LLDPE, avoids potential contamination between the sifter insert and the material being sifted, which is of particular concern when the material being sifted is food or other types of human or animal consumable products.

Further aspects of the invention will become apparent upon reading the following detailed description and drawings, which illustrate the invention and preferred embodiments of the invention.

BRIEF DESCRIPTION OF THE DRAWINGS

In the drawings, which illustrate embodiments of the invention:

FIG. 2A is a top perspective view of the sifting device with the input box shown as transparent to facilitate illustration of the invention;

DETAILED DESCRIPTION OF THE PREFERRED EMBODIMENTS

Preferred embodiments of the invention and its advantages can be understood by referring to the present drawings. In the present drawings, like numerals are used for like and corresponding parts of the accompanying drawings.

Figure 1:
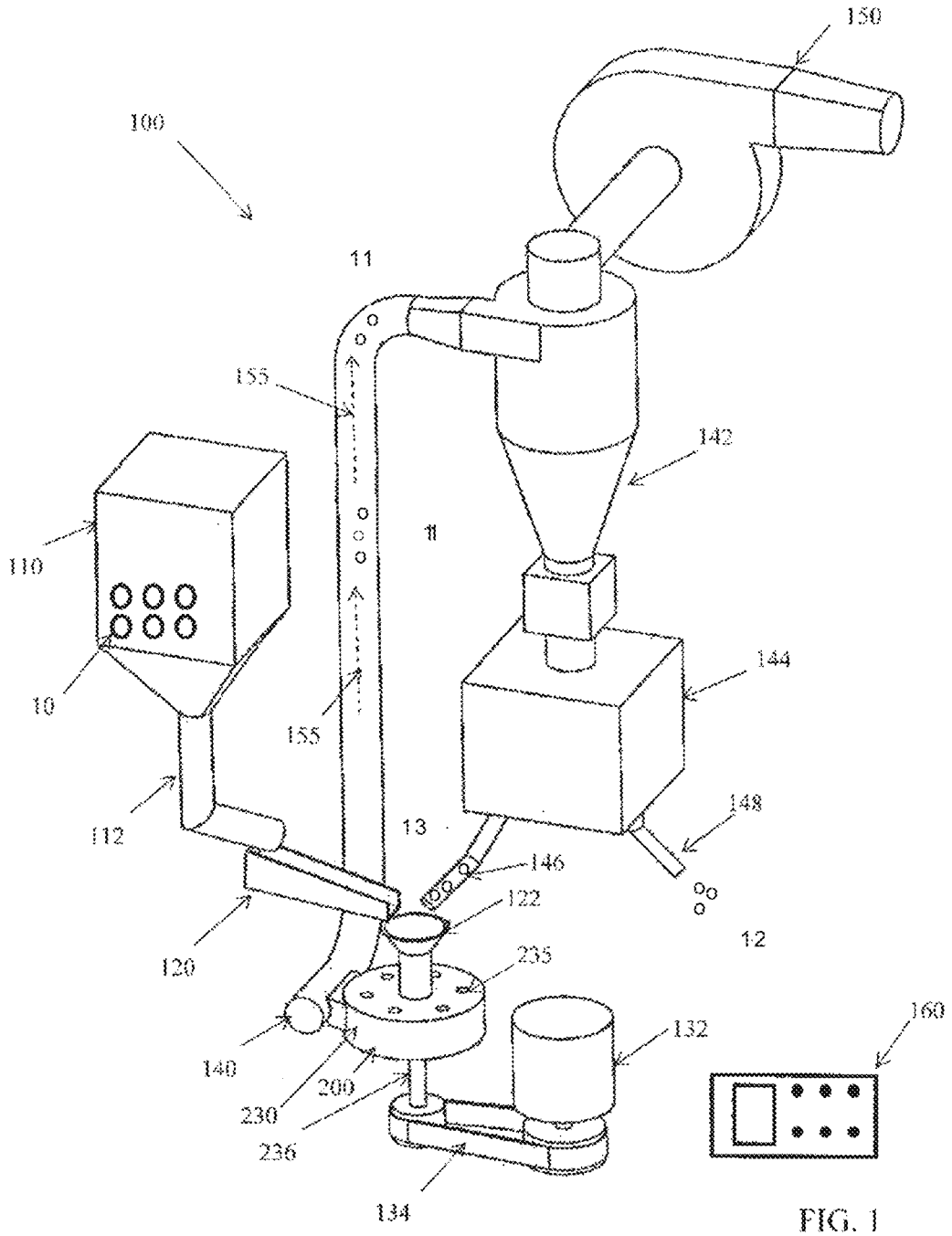
FIG. 1 is a drawing showing an overall reducing machine including the sifting device according to one embodiment of the present invention.

As shown in FIG. 1, one embodiment of the present invention relates a sifting device 144 (also referred to as a classifier or separator) may be used as part of a reducing apparatus, shown generally by reference number 100. The reducing apparatus 100 may reduce raw material, shown generally by reference numeral 10. Generally, the raw material 10 is held in a hopper 110, which has an input chute 112 leading to a tray 120 which allows the raw material 10 to fall into a funnel 122. The funnel 122 may be connected to a mill assembly, as shown generally by reference numeral 200. The mill assembly 200 comprises a mill housing 230 which may house discs (not shown) to reduce the raw material 10.

The reducing apparatus 100 may also comprises a motor 132 for rotating a rotating shaft (not shown) by means of a pulley 134 or any other type of mechanical connection. The rotating shaft is housed in a rotating shaft housing 236 connected to one of the discs such that the motor 132, pulley 134 and shaft 136 cause the disc to rotate with respect to stationary disc.

The apparatus 100 preferably also comprises a fan 150 which creates a negative air pressure in the duct 140 and causes air to flow along a particle path shown generally by the dashed arrow and identified by reference numeral 155. The reduced material, shown generally by reference numeral 11, is generally entrained in the air flow 155 caused by the fan 150 and thereby removed from the mill assembly 200. In one aspect of this embodiment, air enters in the mill assembly 200 through air inlets 235 located on the housing lid 232 of the mill housing 230.

The reduced material 11 entrained in the air flow 155 passes through the duct 140, to a cyclone 142. From the cyclone 142, the reduced material 11 passes down to a separator or sifting device 144. Generally, there may be a filter (not shown) from the fan 150 exhaust to prevent reduced material 11 exiting to the environment.

The sifting device 144 will separate the reduced material 11 into a finished or desired material 12 and oversized or not been properly reduced material 13. Any reduced material 11 that has not been properly reduced may be directed through the "oversized" material chute 146 and re-fed into the funnel 122 together with new raw material 10 to be processed in the mill assembly 200. Any properly reduced or finished material 12 will be directed to the "good" or finished material chute 148 where it can be used as required. A controller, shown generally by reference numeral 160, may control the reducing apparatus 100 and may comprise sensors, such as temperature sensors (not shown) to sense the temperature of the reducing machine 100 at different locations and may also sense the temperature of the sifting device 144.

Figure 2B:
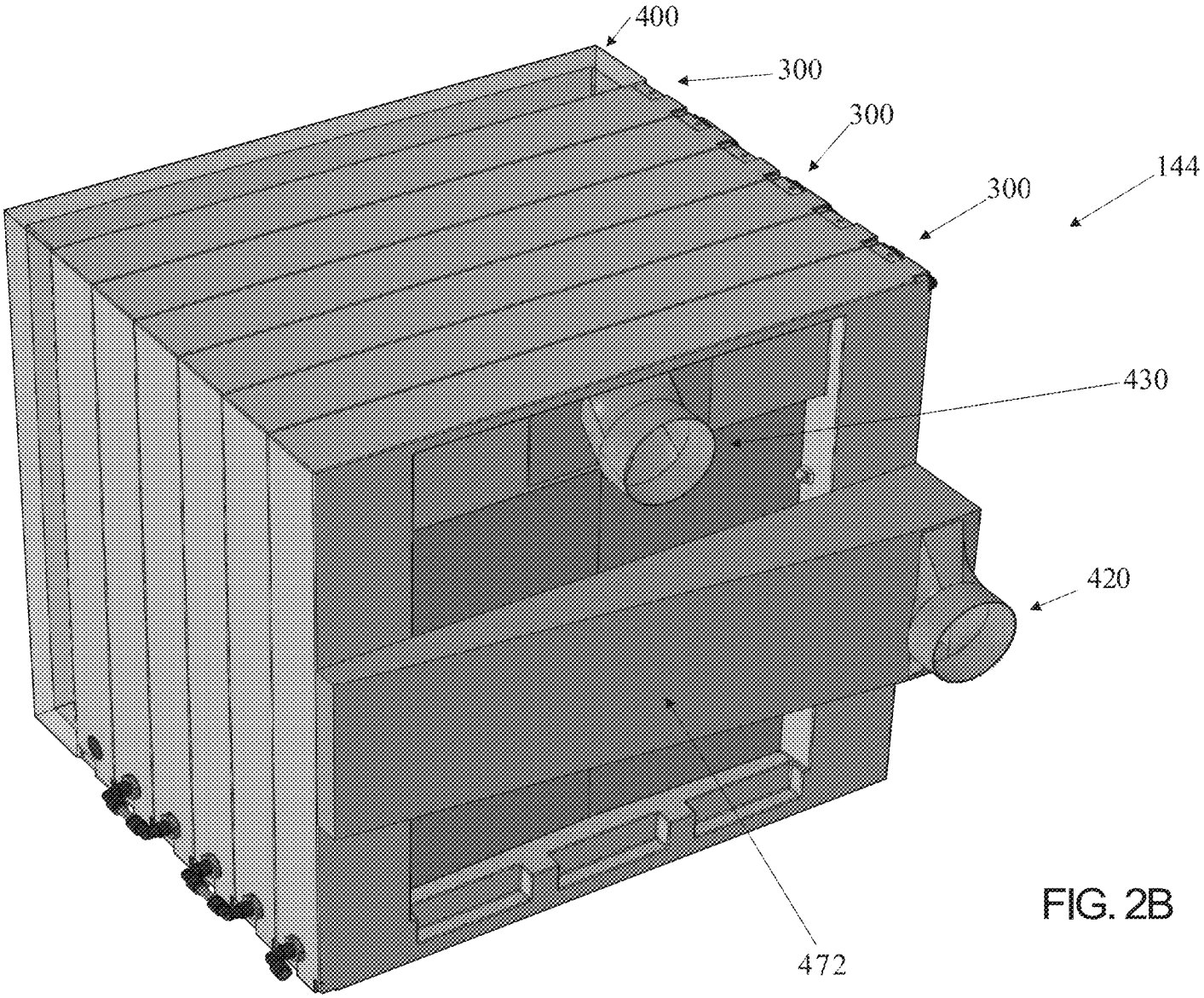
FIG. 2B is a bottom perspective view of the sifting device shown in FIG. 2A

FIGS. 2A and 2B illustrate the sifting device 144 in further detail according to one preferred embodiment of the present invention. As shown in FIGS. 2A and 2B, the sifting device 144 may comprise one or more, and preferably 10 or 15, sifter boxes, each sifter box identified generally by reference numeral 300, in a stacked relationship. Also, in a preferred embodiment, the sifter boxes 300 are generally identical to each other so that they can be interchanged and, to decrease cost and inventory requirements. The sifter boxes 300 are separate units and the number of stacked sifter boxes 300 that could be used with any particular sifting device 144 may change in particular applications. However, it is understood that a greater number of sifter boxes 300 in the sifting device 144 may provide better separating or classification of the reduced material 11 which is also input material 11 to the sifting device input material 11.

Figure 4A:
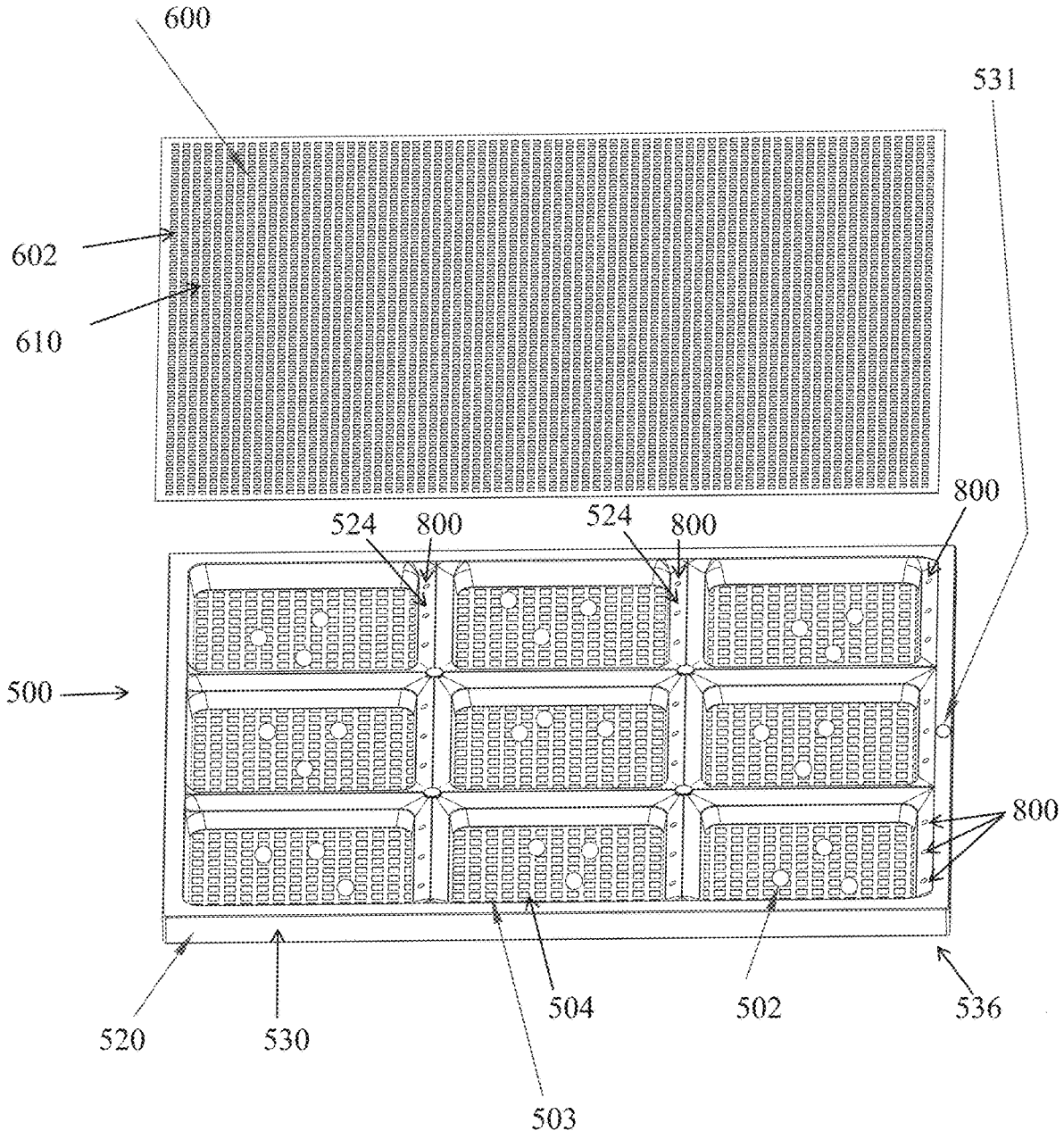
FIG. 4A is an exploded view of the screen insert with the screening media separated from the insert frame for ease of illustration.
Figure 4B:
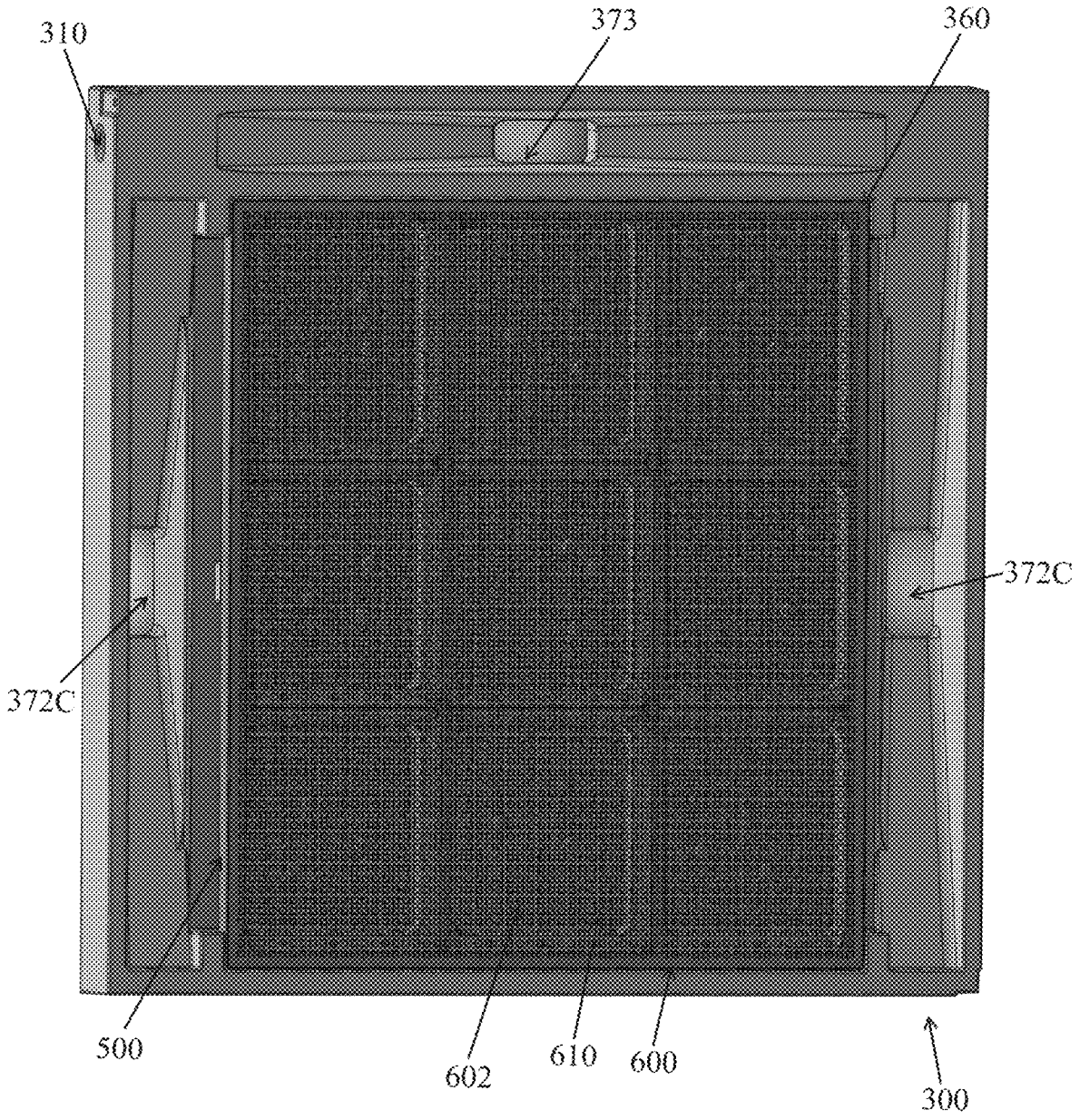
FIG. 4B is an assembled view of the sifter box, screen insert and screening media according to one preferred embodiment.
Figure 10:
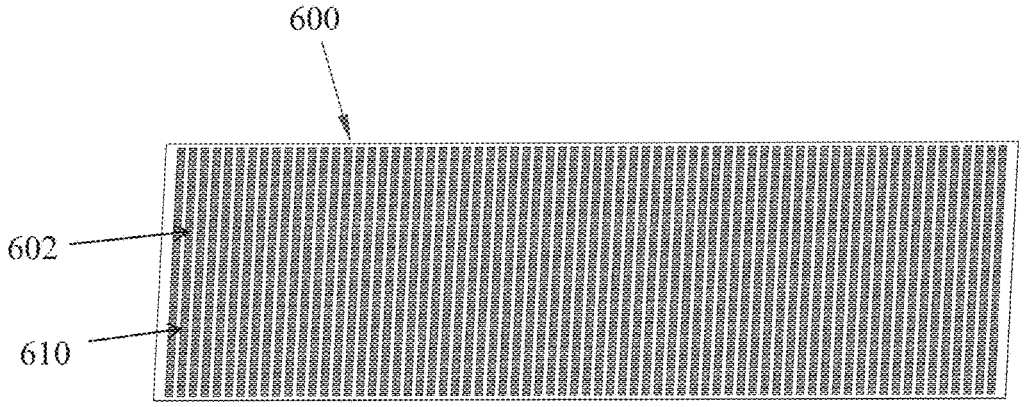
FIG. 10 is an illustration of a sifter box and screening media associated therewith according to a further preferred embodiment.
Figure 10:
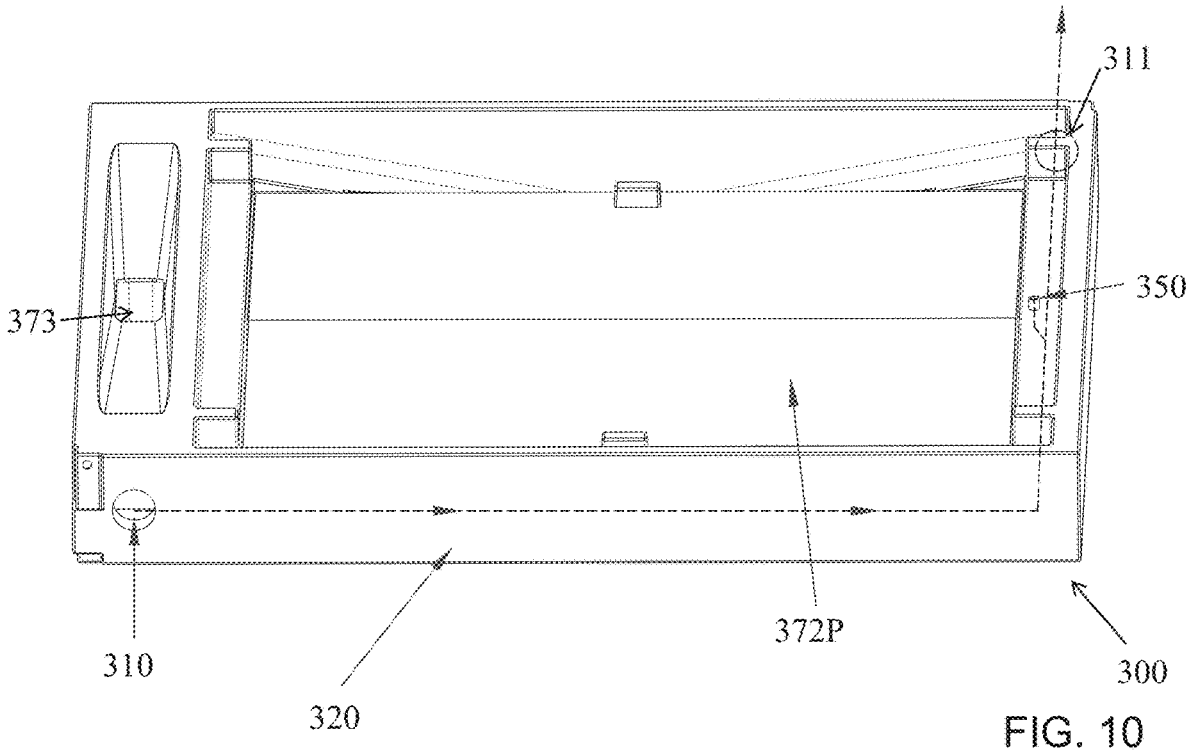

Each sifter box 300 is associated with a screening media, identified generally by reference numeral 600, as shown, for instance, in FIGS. 4A, 4B and 10. The screening media 600 typically has a plurality of openings 610 sized to permit the passage of finished material 12, but prevent the passage of non-finished materials, such as oversized, or not properly reduced material 13. In this way, the screening media 600 operates to classify the input material 11 inputted into the sifting device 144 into finished material 12 and non-finished material 13. Thus, the screening media 600 has a plurality of openings 610 for separating finished material 12 from unfinished material 13. This separation process of the screening media 600 is somewhat similar to the separation process of a common sieve.

It is understood that the input material 11 includes finished material 12 and unfinished material 13 which have not yet been separated. Accordingly, reference to input material 11, or material 11,12,13 being separated, shall be considered to refer to the combined and not yet separated finished material 12 and unfinished material 13. Similarly, the unfinished material 13 may include finished material 12 that has not yet been separated.

Figure 5:
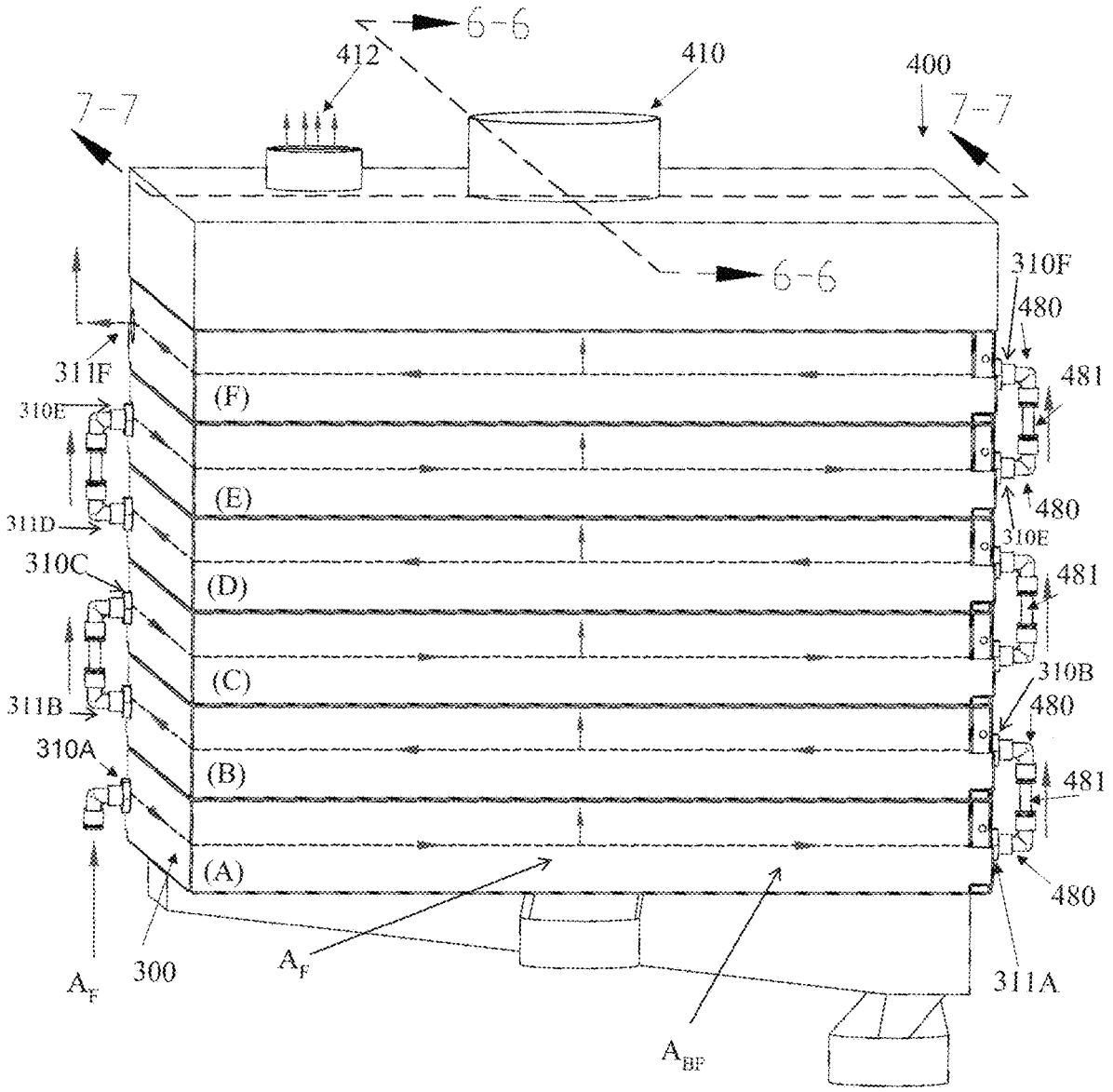
FIG. 5 is a perspective view of the sifting device showing the air flow through the stacked sifter boxes according to one preferred embodiment of the invention.
Figure 6:
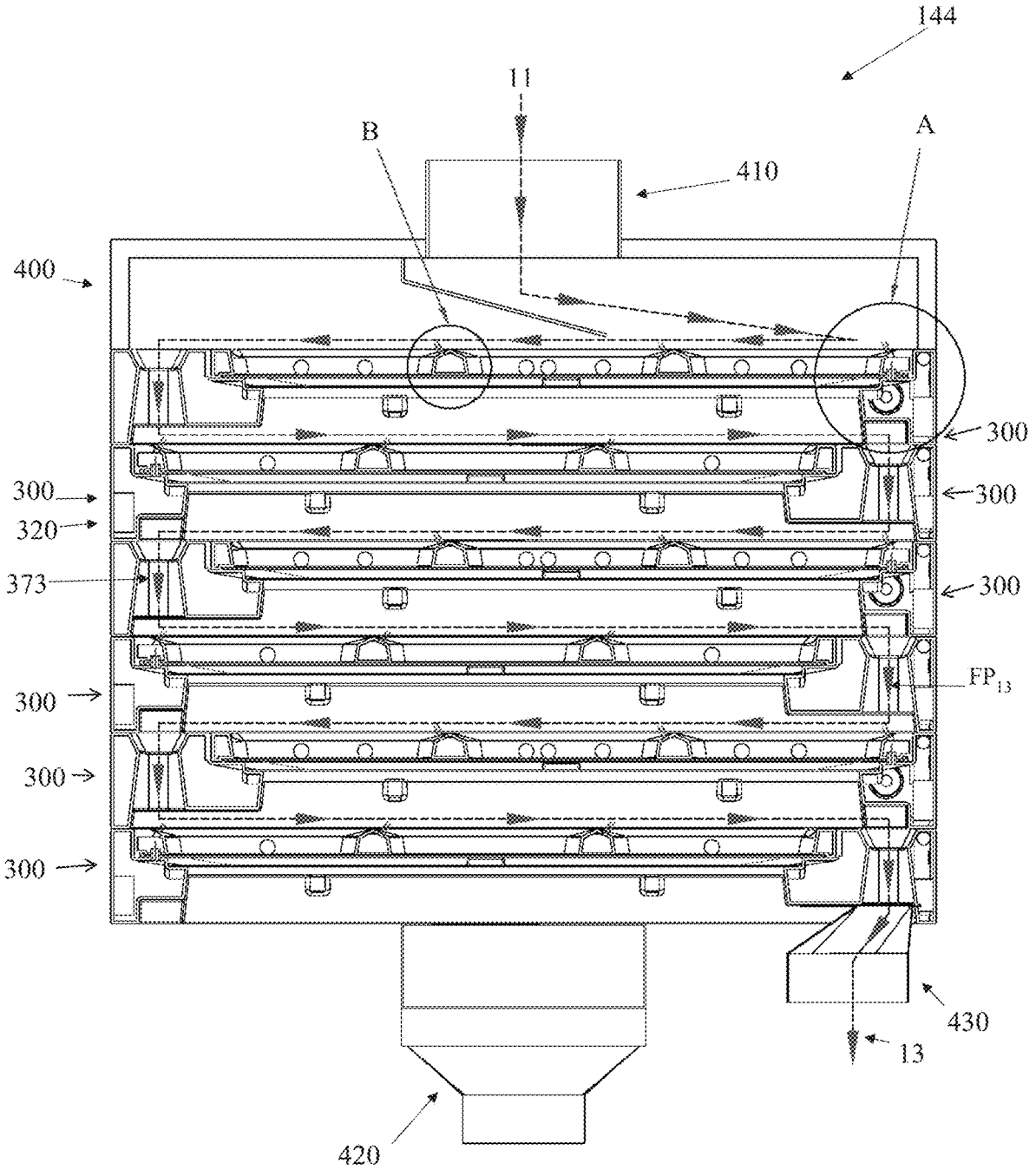
FIG. 6 is a cross-sectional view of the sifting device shown in FIG. 5 along line 6-6 showing the over-sized material flow.
Figure 7:
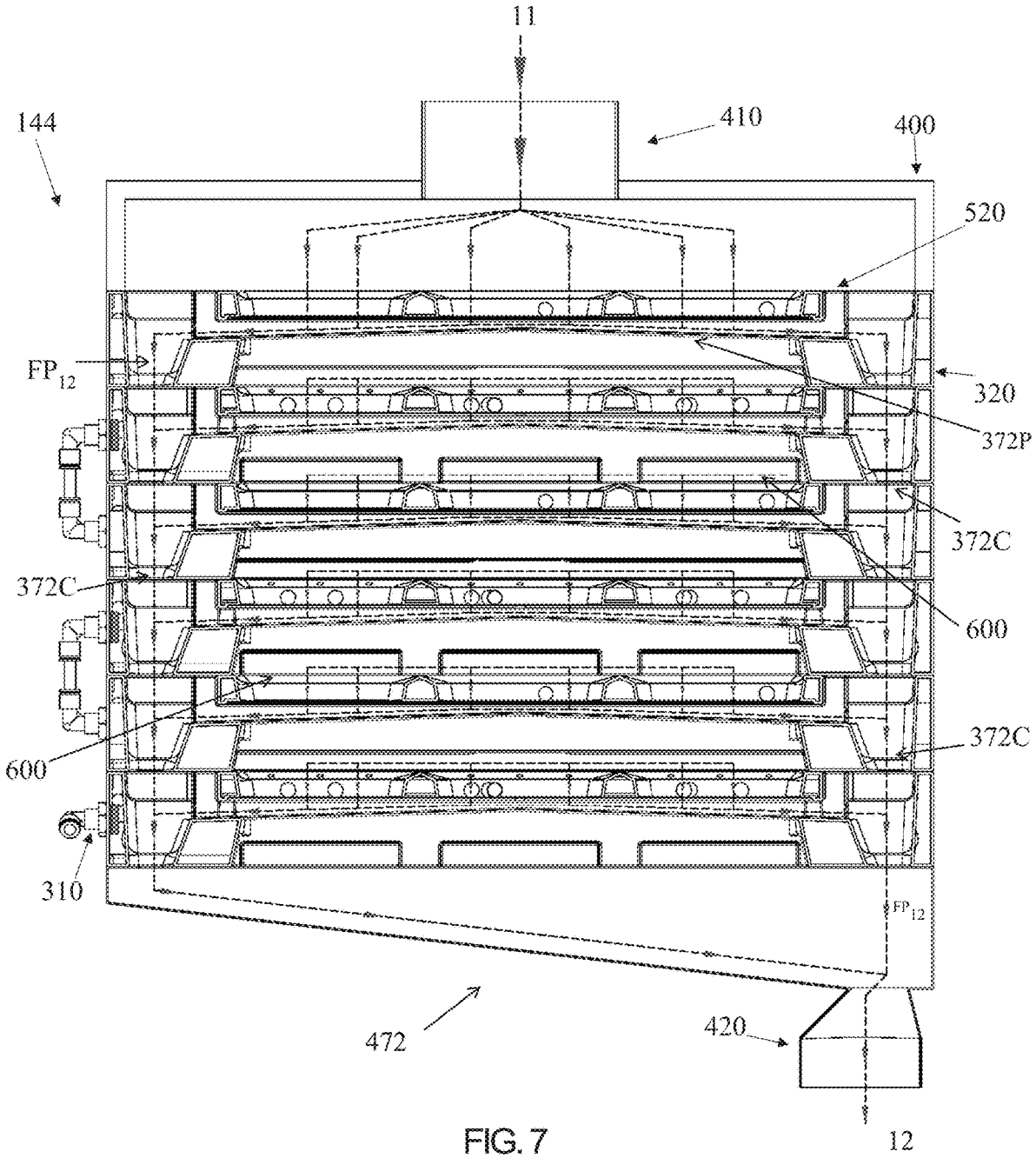
FIG. 7 is a cross-sectional view of the sifting device shown in FIG. 5 along line 7-7 showing the finished material flow.

As shown, for instance, in FIGS. 2A and 2B, as well as in FIGS. 5, 6 and 7, the sifting device 144 may have an input box 400 on top of the stacked sifter boxes 300. The input box 400 may comprise a material input chute 410 for receiving input material 11 to be separated. In the embodiment where the sifting device 144 forms part of a reducing apparatus 100, the material input chute 410 may receive reduced or input material 11 from the cyclone 142. The input box 400, according to one preferred embodiment, may also have an air vent 412. The air vent 412 may expel air that has been introduced into the sifter box 144 and/or has been expelled by the plurality of channel holes 800, as discussed below.

The sifting device 144 may also have a finished particle output 420 for the finished material 12 that has passed through one of the screening media 600 of the stacked sifter boxes 300. The sifting device 144 may also comprise a non-finished particle output 430 for outputting from the sifting device 144 the input material 11 that has not passed through one of the screening media 600, which material is identified as non-finished material 13. However, it is understood that the output from the non-finished particle output 430 may have some finished material 12, such as 5 to 20%, that has simply not passed through one of the screening media 600 and not yet been separated. Therefore, the non-finished material 13 that is outputted from the non-finished particle output 430 may be reintroduced, possible with new input material 11, into the material input chute 410, for further processing and classification in the sifting device 144.

Alternatively, in cases where the sifting device 144 forms part of a reducing apparatus 100, the non-finished material 13 (including any non-separated finished material 12) may be re-introduced into the funnel 122 to be further processed in the mill assembly 200. In this case, the non-finished particle output 430 may send the non-finished material 13 to the "oversized" material chute 146 and the finished particle output 420 may send the finished material 12 to the "good" material chute 148 of the reducing apparatus 100.

Figure 3A:
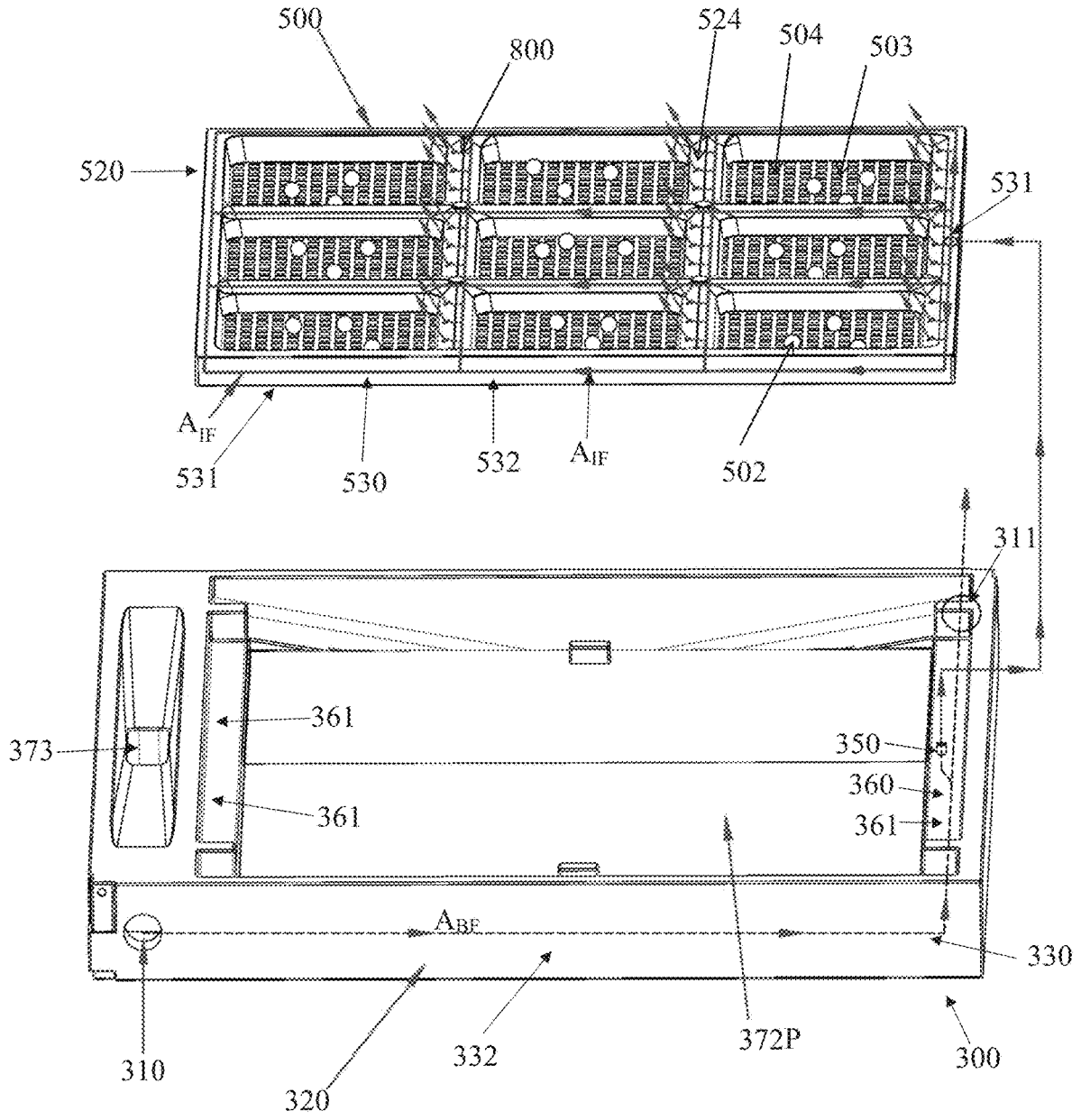
FIG. 3A is an exploded top view and FIG. 3B is an exploded bottom view of a sifter box and screen insert according to one preferred embodiment with the screening media removed for illustration purposes and with FIG. 3A showing the air flow through the box frame air channel, insert frame air channel and plurality of channel holes.
Figure 3B:
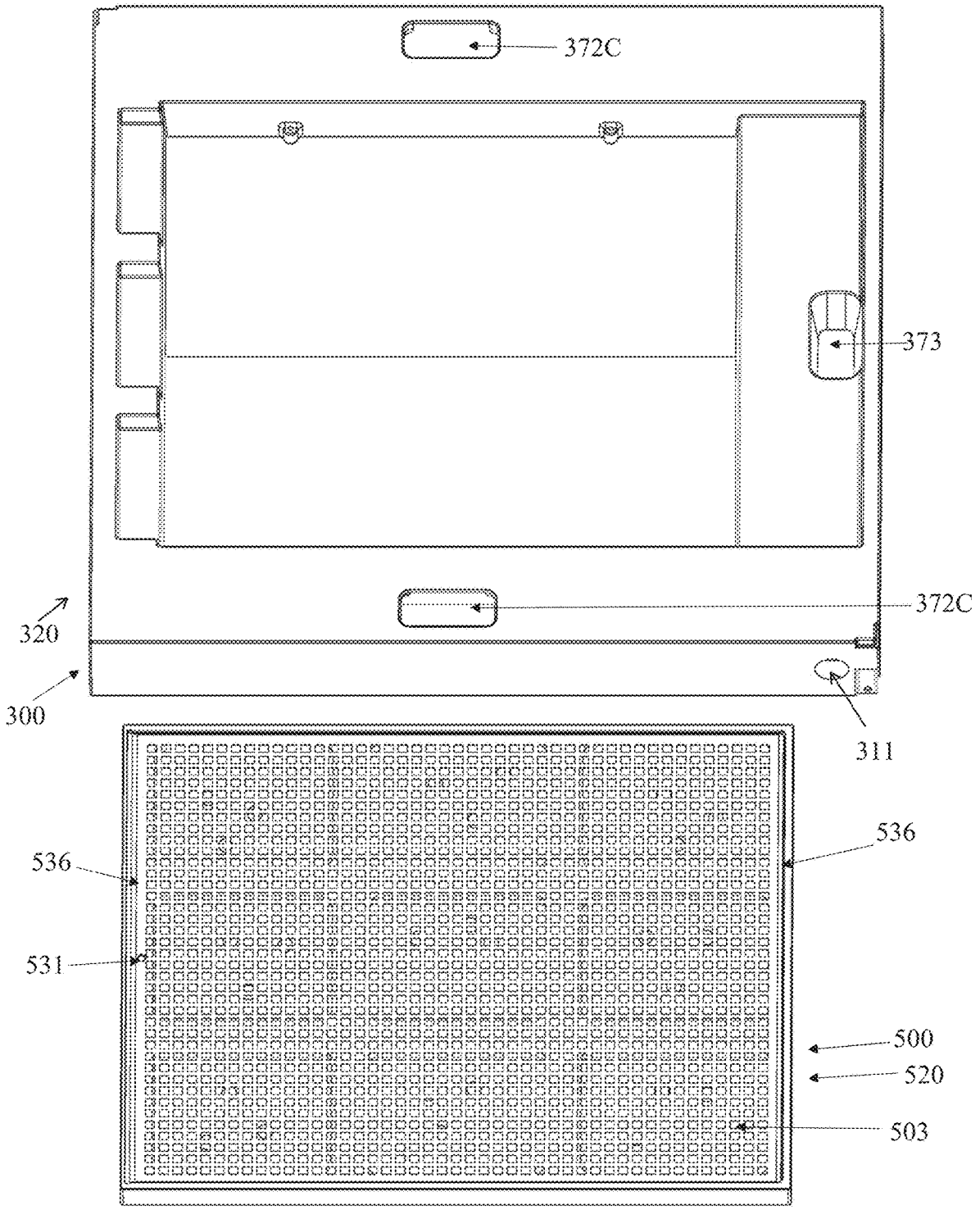

As illustrated in FIGS. 3A, 3B and 5, each sifter box 300 preferably comprises a sifter box frame 320. The sifter box frame 320 comprises a box frame air channel 330 therein. The box frame air channel 330 located within the corresponding sifter box frame 320 has a box air inlet 310, for receiving air therein, and a box air outlet 311, for expelling air that has passed through at least a portion 332 of the box frame air channel 330. In one preferred embodiment, as illustrated in FIGS. 3A, 3B and 5, the box frame inlet 310 and the box frame outlet 311 face the exterior of sifter box frame 320. In this regard, the box frame outlet 311 is shown in dashed lines in FIG. 3A representing that it is on the opposite side of the sifter box frame 320. Alternatively, the box frame inlet 310 and outlet 311 may face upwards and/or downwards (not shown) so as to fluidly connect with adjacent stacked sifter boxes 300.

FIG. 3A illustrates the air flow $A_{BF}$ passing through the box frame air channel 330. The box frame air channel 330 is preferably enclosed such that the box frame air flow $A_{BF}$ passing through the box frame air channel 300 is constrained to pass through the box frame air channel 300 and not escape therefrom. The box frame air flow $A_{BF}$ passing through the box frame air channel 330 has the effect of cooling the sifter box 300. In this way, the associated screening media 600 may also be cooled.

Given the cooling effect of the air passing through at least a portion 332 of the box frame air channel 330, it is understood that the sifter box 300 may be manufactured from plastic, or other types of polymer materials, while the screening media 600 may be manufactured from metal, or similar types of material. This is the case because the cooling effect of the box frame air flow $A_{BF}$ passing through the box frame air channel 330 may prevent potentially adverse and detrimental thermal damage which could arise given potential differences in thermal expansion coefficients of plastic and metal. In other words, the ability to air cool the sifter box 300 and the associated screening media 600 by having air pass through the box frame air channel 330, permits materials having different thermal expansion coefficients to be used for the sifter box 300 and screening media 600.

In one preferred non-limiting embodiment, the screening media 600 is affixed to the associated sifter box 300 as shown, for instance, in FIG. 10. In another preferred non-limiting embodiment, the sifting device 144 comprises a screen insert 500 for holding the screening media 600 associated with the sifter box 330 as illustrated, for instance, in FIGS. 2A, 2B, 4A and 4B.

In the embodiment where the sifting device 144 comprises screen inserts 500, the screen insert 500 may comprise an insert frame 520 which is sized and shaped to be received within the sifter box frame 320. This is illustrated, for instance, in FIGS. 3A, 3B and 4B where the insert frame 520 of the screen insert 500 may be received within the insert box 300.

FIG. 4B illustrates the assembled sifter box 300 and screen insert 500 holding the associated screening media 600 and the insert frame 520 received by the sifter box 320. In this embodiment, the screening media 600 may be affixed to the insert frame of the screen insert 500, such as with adhesives, such as glues and/or melted glues, or by mechanical means, such as staples or nails.

As illustrated, for instance, in FIG. 3A, the insert frame 520 may also comprise an insert frame air channel 530 located within the insert frame 520. The insert frame air channel 530 may have an insert frame air intake 531 for receiving air which passes through at least a portion 532 of the insert frame air channel 530. [In FIGS. 3A and 4A, the insert frame air intake 531 is shown in dashed lines representing that it is on the opposite side of the insert frame 520 while in FIG. 3B, which is the bottom view of FIG. 3A, the insert frame air intake 531 is shown in solid lines.] The air received through the insert frame air intake 531 may be received from the box frame air channel 330. In this way, the insert frame air intake 531 may be in fluid communication with the box frame air channel 530 for communicating air from the box frame air channel 330 to the insert frame air channel 530 through the insert frame air intake 531.

As also shown in FIG. 3A, the sifter box 300 may comprise a box/screen air outtake, identified generally by reference numeral 350. The box/screen air outtake 350 may fluidly connect to the corresponding insert frame air intake 531 associated with the insert frame 520 when the insert frame 520 is received by the sifter box frame 320. In this way, the box/screen air outtake 350 permits a portion of the air passing in the box frame air channel 330 to flow into the insert frame air intake 531 and pass through at least a portion 532 of the insert frame air channel 530 located within the insert frame 520.

FIG. 3A illustrates the insert frame air flow $A_{IF}$ passing through the insert frame air channel 530. The air passing through the insert frame air channel 530 has the effect of cooling the insert frame 520 and may cool the associated screening media 600 affixed to the insert frame 520. The insert frame air channel 530 is preferably enclosed, similar to the box frame air channel 330, so that the insert frame air flow $A_{IF}$ passing through the insert frame air channel 530 is constrained to pass through the insert frame air channel 530 and not escape therefrom, except for the plurality of channel holes 800 as discussed below.

As illustrated in FIGS. 2A, 3A and 4B, the sifter box 300 may comprise a screen insert seat 360 for receiving and the screen insert 500. The sifter box frame 320 is sized and shaped to receive the insert frame 520. The screen insert seat 360 preferably comprises a flange 361 which engages a portion 536 of the insert frame 520. When the portion 536 of the insert frame 520 engages the box/screen insert seat 360, the box/screen air outtake 350 of the sifter box 300 is fluidly connected to the corresponding insert frame air intake 531 of the associated screen insert 500. This permits the insert frame air intake 531 to receive air from the box frame air channel 330 which air then passes through at least a portion 532 of the insert frame air channel 530.

In this preferred embodiment, the insert frame air intake 531 is oriented within the portion 536 of the insert frame 520 which engages the flange 361, as shown for instance in FIG. 3B, and, the box/screen air outtake 350 is oriented on the flange 361 of the screen insert seat 360 of the sifter box 300, as shown for instance in FIG. 3A. This is one preferred manner to have the insert frame air intake 531 in fluid communication with the box frame air channel 330 for communicating air from the box frame air channel 330 to the insert frame air channel 530 through the insert frame air intake 531. Moreover, this arrangement permits the box/screen air outtake 350 of the sifter box 300 to be fluidly connected to the insert frame air intake 531 of the screen insert 500 when the portion 536 of the insert frame 520 is engaging the flange 361 of the screen insert seat 360.

As indicated above, and illustrated in detail view 8A, when the insert frame 520 is received by the sifter box frame 320, the insert frame air intake 531 of the insert frame 520 is fluidly connected to the corresponding box/screen air outtake 350 associated with the sifter box frame 320. In this way, the corresponding box/screen air outtake 350 permits a portion of the air passing in the box frame air channel 330 of the sifter box 300 to flow into the insert frame air channel 530 through the insert frame air intake 531.

As also illustrated in detailed view 8A, in one preferred embodiment, the box/screen outtake 350 comprises a nipple 351 which may be received in the insert frame air intake 531 of the screen insert 500. In this way, the nipple 351 may extend into the insert frame air channel 530. Furthermore, when the portion 536 of the insert frame 520 engages the flange 361 of the screen insert seat 360, the insert frame air intake 531 may form a friction seal with the outer surface of the nipple 351 and/or the flange 361 thereby decreasing air leakage. This is one preferred non-limiting embodiment permitting fluid communication between the box/screen air outtake 350 and the insert frame air intake 531, but it is understood that alternate embodiments are possible.

In a preferred non-limiting embodiment, the screening media 600 is affixed to the insert frame 520. In FIG. 4A, the screening media is shown separated from the insert frame 520 for ease of illustration, but FIG. 4B shows an assembled view with the screening media 600 shown affixed to the insert frame 520 and with the insert frame 520 received by the sifter box frame 320. The screening media 600 has a plurality of openings 610 for separating finished material 12 from non-finished material 13. For instance, the plurality of openings 610 may be sized to permit passage of a finished material 12 and prevent passage of oversized or not properly reduced non-finished material 13. The insert frame air channel 530 located within the insert frame 520 receives air from the insert frame air intake 531 and the air passes through at least a portion 532 of the insert frame air channel 530. The passage of air through at least a portion 532 of the insert frame air channel 530 facilitates heat transfer between the air and the screening media 600 affixed to the insert frame 520. In general, heat will be transferred from the screening media 600 to the air to cool the insert frame 520 and the screening media 600 affixed thereto. Accordingly, the screen insert 500 and the screening media 600 may be made from materials that have differing thermal expansion coefficients as the temperature increase during use is expected to be controlled and/or mitigated by the air passing in the insert frame air channel 530. In other words, the ability to air cool the screen insert 500, including the insert frame 520 and the screening media 600, by having air pass through the insert frame air channel 530, permits materials having different thermal expansion coefficients to be used for the insert frame 520 and screening media 600. For example, the screening media 600 may be made from metal and the insert frame 520 of the screen insert 500 may be made from a polymer, such as plastic.

As illustrated, for instance in FIGS. 3A and 3B, as well as FIG. 6, the box frame 320 is formed with internal chutes 373 for unfinished material 13 to flow. As illustrated in FIG. 6, the unfinished material 13 will flow through the non-finished material flow path $FP_{13}$. In this way, input material 11, including oversized material 13 and finished material 12 that has not yet been separated, will pass through the internal chute 373 if they have not yet passed through the screening media 600. The non-finished material flow path $FP_{13}$ thus directs the non-finished material 13 which has not yet passed through a screening media 600 to the associated screening media 600 of sifter boxes 300 located adjacent and downstream in the non-finished material flow path $FP_{13}$. The non-finished material flow path $FP_{13}$ will end at the non-finished particle output 430 as shown, for instance, in FIGS. 2A, 2B and 6.

Similarly, material that passes through the associated screening media 600 of one of the sifter boxes 300 will pass through the finished material flow path $FP_{12}$ which is shown in FIG. 7. Preferably, the box frame 320 is formed with internal chutes 372C for the finished material 12. The finished material flow path $FP_{12}$ terminates at the finished particle output 420 as shown in FIGS. 2A, 2B and 7. The finished material 12 emanating from the finished particle output 420 would have the desired size and/or shape to have passed through at least one of the screening media 600 and, therefore, should be available for use. Moreover, the finished material 12 emanating from the finished particle output 420 may have been cooled through the air flow $A_F$ passing through the sifting device 144.

As illustrated in FIG. 7, as well as in FIG. 3A, the box frame 320 may comprise a finished material pan 372P which receives the finished material 12 that has passed through the associated screening media 600 of the sifter box 300. The finished material chute 372C will receive finished material 12 from the finished material pan 372P and the finished material chutes 372C of the box frames 320 upstream in the finished material path $FP_{12}$. In this way, the finished material 12 passes along the finished material path $FP_{12}$ to the finished material output 420. FIG. 2B shows a final finished material pan 470 for finished material 12 that has passed through the screening media 600 and flowed through the finished material chute 372C at the distant end of the sifter boxes 300 with respect to the finished material output chute 520.

In a further preferred embodiment, the insert frame 520 comprises a plurality of channel holes, identified generally by reference numeral 800, in fluid communication with the insert frame air channel 530, to permit air to pass from the insert frame air channel 530 to the screening media 600. These plurality of holes 800 and the air passing therethrough are shown best in FIGS. 3A and 4A, and, in detailed view FIG. 8B.

As shown in FIGS. 3A and 4A, the plurality of channel holes 800 are preferably oriented to direct air to a screening surface 602 of the associated screening media 600. While the screening media 600 is removed for illustration purposes in FIG. 4A, and shown separated from the insert frame 520, it is understood that the screening media 600 would be attached to the insert frame 520, as shown in FIG. 4B. Thus, the arrows shown in FIG. 3A. illustrating air emanating from the plurality of holes 800, represent air directed to the screening surface 602 of the screening media 600 that would be attached to the insert frame 520. In this way, air passing through the plurality of channel holes 800 from the insert frame air channel 530 would be directed to the screening surface 602 of the screening media 600. This air may facilitate cooling of the material 11,12,13 being separated on the screening surface 602 of the screening media 600. Because the input material 11 may be at an elevated temperature when entering the material input chute 410, cooling the material 11,12, 13 being separated on the screening surface 602 decreases any thermal expansion which could be caused by this elevated temperature thereby potentially improving the accuracy of the separation process by the screening media 600. Furthermore, this cooling may ameliorate agglomeration of material 11,12,13 being separated, further improving the efficiency of the sifting device 144. A further advantage of this arrangement is that the air so directed to the screening surface 602 of the associated screening media 600 could also cause the material 11,12,13 being separated to become agitated, improving their interaction with the screening media 600 and facilitating the separation process of the material 11,12,13 on the screening media 600.

As is known in the art, balls 502 may also be contained in the screen insert 500. As illustrated, for instance, in FIGS. 3A and 4A, these balls 502, which are generally rubber balls or nylon balls, may also cause agitation of the material 11,12,13 being separated on the screening surface 610 of the screening media 600 to facilitate interaction of the material through the screening media 600.

The insert frame 520 may also comprise a lower screen 503 which has larger openings 504. These larger openings 504 are intended to permit the finished material 12 that has passed through the screening media 600 to pass onto the finish material pan 372P of the sifter box frame 320 and continue onto the finished material path $FP_{12}$, as also shown in FIG. 7.

In one preferred embodiment, to facilitate the orientation of the plurality of channel holes 800, and therefore the direction of the air emanating from the plurality of holes 800, the insert frame 520 may have an angled surface 524 which is at an acute angle to the associated screening media 600. As illustrated, for instance, in FIGS. 3A, 4A and 8B, the plurality of channel holes 800 may be formed on the angled surfaces 524. In this way, the direction of the air emanating from the plurality of channel holes 800 may be directed towards the screening media 600. It is understood that the angled surface 524 would also facilitate the flow of the finished material 12 down to the larger openings 504 in the lower screen 503.

Figure 8A:
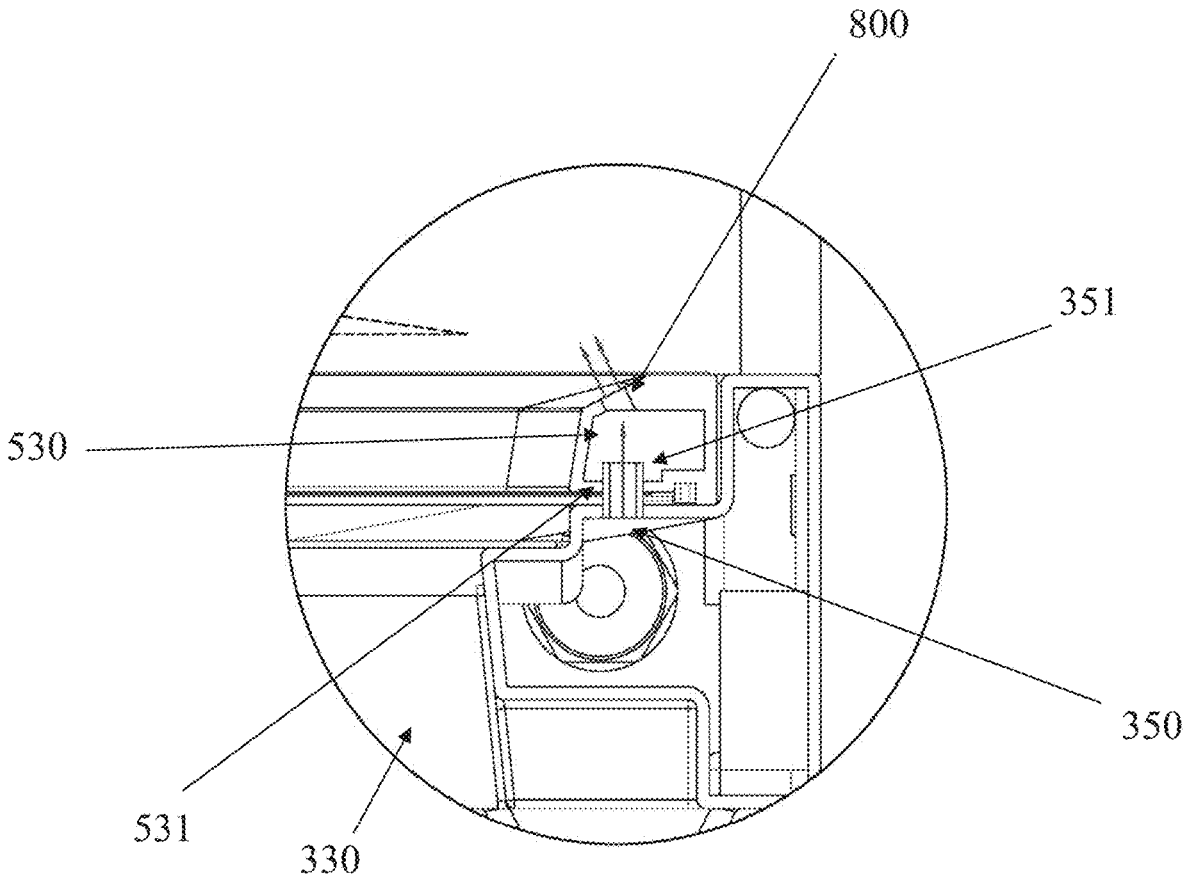
FIG. 8A is a detailed view of enlarged circle A shown in FIG. 6 illustrating the fluid communication between the box frame air channel and the insert frame air channel according to one preferred embodiment of the invention.
Figure 8B:
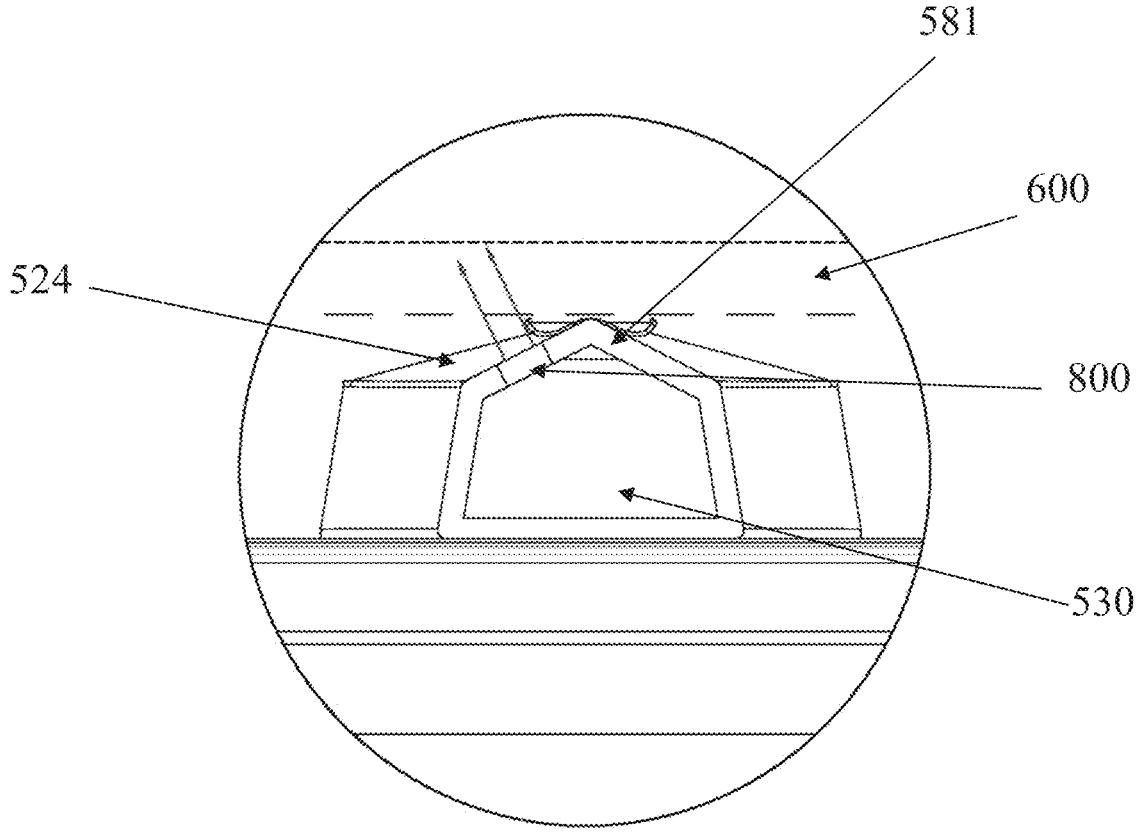
FIG. 8B is a detailed view of enlarged circle B shown in FIG. 6 illustrating the air flow through one of the plurality of channel holes according to a preferred embodiment of the present invention.

As shown in FIG. 8B, in a further a preferred non-limiting embodiment, the plurality of holes 800 extend into the insert frame air channel 530, preferably formed on the angled surfaces 524. The air in the insert frame air channel 530 will generally be compressed air and, therefore, under pressure. In this way, air will emanate from the plurality of holes 800 and be directed toward the screening media 600, as well as towards any material 11,12,13 being separated on the screening surface 610 of the screening media 600. The air passing through the plurality of channel holes 800 from the insert frame air channel 530 to the screening surface 610 of the screening media 600 facilitates cooling and movement of the finished material 12 and non-finished material 13 on the screening surface 610 of the screening media 600 to improve separation on the screening media 600. This also facilitates the interaction of the input material 11, which comprises both finished material 12 and unfinished material 13, being separated on the screening surface 602 of the screening media 600 and improves the overall efficiency of the sifting device 144.

In a further preferred embodiment, the angled surface 524 upon which the plurality of openings 800 are formed, and/or the wall 581 of the insert frame 520 to which the screening media 600 is affixed, may have increased thermal conductivity. In other words, in a preferred embodiment, a screen/channel interface wall 581, as shown for instance in FIG. 8B, forming part of the insert frame air channel 530, may have increased thermal conductivity. This increased thermal conductivity could result, for instance, from the screen/channel interface wall 581 having a different thickness or different composition with improved thermal conductance, such as a different type of plastic, or fins (not shown) being present along the insert frame air channel 530 in the vicinity or on the screen/channel interface wall 581. This could further facilitate the transfer of heat from the screening media 600 to the air passing through the insert frame air channel 530.

Furthermore, it is understood that the air emanating from the plurality of channel holes 800 of each of the stacked insert frames 520 would also then pass through the additional screening media 600 of the stacked sifter boxes 300 and emanate ultimately from the air vent 412 and the input box 400. Because of this, the entire sifting device 144 may be under positive pressure which facilitates the cooling of the entire sifting device 144 as well as the material 11,12,13 being sifted on the screening media 600 associated with the stacked sifter boxes 300 because the air emanating from the plurality of channel holes 800 will travel upward and be exhausted from the air vent 412.

FIG. 5 illustrates the sifting device air flow $A_F$, including the box frame air channel air flow $A_{BF}$ through each of the box frame air channels 330 of each of the stacked sifter boxes 300 in the sifting device 144. As illustrated in FIG. 5, as well as in FIG. 2, the sifter boxes 300 are arranged in a stacked relationship with each sifter box 300 associated with a screening media 600. In this preferred embodiment, the screening media 600 is held in its corresponding insert frames 500 which have been received in the corresponding sifter boxes 300.

In FIG. 5, the air flow $A_F$ of the sifting device 144 comprises compressed air being injected into the box air inlet 310 of the box frame air channel 330 of the box frame 300 at the lowest position. However, it is understood that air could also be inserted into any one of the other box air inlet 310 of the other box frame channels 330.

As is apparent from FIGS. 3A, 3B, 4A, 4B and FIG. 5, in a preferred non-limiting embodiment, the box air inlet 310 may be located diagonally opposed from the box air outlet 311 of the box frame air channel 330 for each of the box frames 300. It is also understood that, in this preferred embodiment, the location of the box air inlet 310 being located diagonally opposed from the box air outlet 311 of the box frame air channel 330 permits the portion 332 of the box frame air channel 330 through which air passes to be greater than if the box air inlet 310 was not diagonally opposed from the box. This increases the amount of time and, therefore, surface contact of the air in each box frame air channel 330 which improves the heat transfer and generally cooling.

Furthermore, with the box air inlet 310 diagonally opposed from the air outlet 311, it is possible to orient the box frames 300 in stacked relationship with each adjacent box 330 rotated 180° with respect to the adjacent sifter box 330 such that the box air inlet 310 of one box frame air channel 330 is located near the adjacent box air outlet 311 of the adjacent sifter box air channel 330.

For example, looking for instance at FIG. 5, the lowest most air box 300, which may be identified with letter A, may have an air outlet 311A near the adjacent air inlet 310B of the box frame 300 identified by letter B. In this way, the sifting device 144 comprises an adjacent sifter box 300B associated with an adjacent screening media 600B and the adjacent sifter box 300B has an adjacent sifter box frame 320B and an adjacent sifter box air channel 330B located within the adjacent sifter box frame 320B with the adjacent box frame air channel 330B having the adjacent box air inlet 310B receiving air therein and an adjacent box air outlet 311B for expelling air that has passed through at least a portion of the adjacent box frame air channel 330B. The first, or lowest, sifter box 300, identified by letter A, is located adjacent to the second or adjacent sifter box 300 identified by letter B, in stacked relationship in the sifting device 144, and the box air outlet 311A of the box frame air channel 330A of the first, or lowest, sifter box 300A is near the adjacent box air inlet 310B of the adjacent sifter box 300B. This facilitates the box air outlet 311A of the box frame air channel 330A being fluidly connected to the adjacent box air inlet 310B of the adjacent box air channel 330B thereto, as illustrated in FIG. 5. This may continue for each of the sifter boxes 300 A to F of the sifting device 144 with each box frame air channel 330 receiving air from the adjacent air outlet 311 of the adjacent box frame air channel 330 of the preceding adjacent sifter box 300. Also, as shown in FIGS. 5 and 6, the non-finished particle flow path $FP_{13}$ directs the non-finished material 13 that has not yet passed through any screening media 600 to the adjacent screening media 600 associated with an adjacent sifter box 300. This continues in the stacked sifter boxes 300 downstream along the non-finished material flow path $FP_{13}$ until the non-finished material 13 is output from the non-finished particle output 430.

In a non-limiting preferred embodiment, as illustrated in FIG. 5, to facilitate the fluid connection between the box air outlet 311A of the sifter box 330A, to the adjacent box air inlet 310B of the adjacent sifter box 330B, two elbow connections 480 may be used. In cases where the elbow connections 480 are not sufficient, an additional intermediate tube or piping 481 may be included, but other arrangements are also possible. This completes the air flow of the sifting device air flow $A_F$ from sifter box air channel 330A of sifter box 300A to the adjacent box frame air channel 330B of the adjacent sifter box 300B. It is understood that a similar arrangement exists for the remainder of the sifter boxes 300 identified as letters A to F in FIG. 5 with the box air outlet 311 being connected to the adjacent box air inlet 310 of the adjacent sifter box 300.

It is understood, however, that the embodiment illustrated in FIG. 5 is a preferred non-limiting embodiment. In other words, the box air inlet 310 need not necessarily be located diagonally opposed from the box air outlet 311 but could be at any other location. Furthermore, while it is preferred to have the box air outlet 311A near the adjacent box air inlet 310B of the adjacent sifter box 300, again this is not necessary. In cases where the box air outlet 311A is not near the adjacent box air inlet 310B of the adjacent box air channel 330B, alternate fluid connection could be used, such as hoses or tubes (not shown), which facilitate a longer and possibly less direct passage of air from the box air outlet 311A to the adjacent box air inlet 310B. However, as would be appreciate, air traveling through such longer tubing (not shown) could increase friction and decrease pressure, but could be separately cooled.

With respect to the initial air input to inlet 310A, this may be connected to a hose (not shown). This is the case because the sifting device 144 may be on an agitator or rotator (not shown) which agitates or rotates the sifting device 144 to facilitate flow of the input material 11, finished material 12 and non-finished material 13 in the device 144. Because of this movement of the sifting device 144, it is preferred that a hose (not shown) be used for the initial input to inlet 310A.

It is also understood that while in general the stacked sifter boxes 300 in a sifting device 144 may be generally identical to each other, this may not always be the case. Rather, it is understood that the sifting device 144 may have only one box 300 with an air channel and other sifter boxes (not shown) without an air channel. Therefore, the sifting device 144 may have several sifter boxes but, only one or some of those may be a sifter box 300 with a box frame air channel 330 according to the present invention. In this case, air may enter and exit through the inlets 310 and outlets 311 of sifter boxes 300 having a box frame air channel 330.

In another non-limiting preferred embodiment, where the screen insert frame 520 does not have a plurality of holes 800, it is understood that air would only pass through at least a portion 332 of the box frame air channel 330 of each of the sifter boxes 300 in stacked relationship. This air passing through the box frame air channel 330 may still have a cooling effect on the associated screening media 600. In embodiments where the screen insert frame 520 does not have a plurality of holes 800, a vacuum could be used rather than compressed air. In this embodiment, air may be drawn out through the last box air outlet 311 of the last sifter box 300, such as sifter box F in FIG. 5. The advantage of having a vacuum rather than compressed air would include the fact that the vacuum source could be obtained from another element. For instance, in embodiments where the sifting device 144 forms part of a reducing apparatus 100, the fan 150 could act as the vacuum source thereby decreasing the number of components. It is understood that a vacuum source would generally not be used in cases where the insert frame 520 has a plurality of holes 800 as, in this case, the suction could cause the finished material 12 to enter through the plurality of holes 800 causing difficulties.

Figure 9:
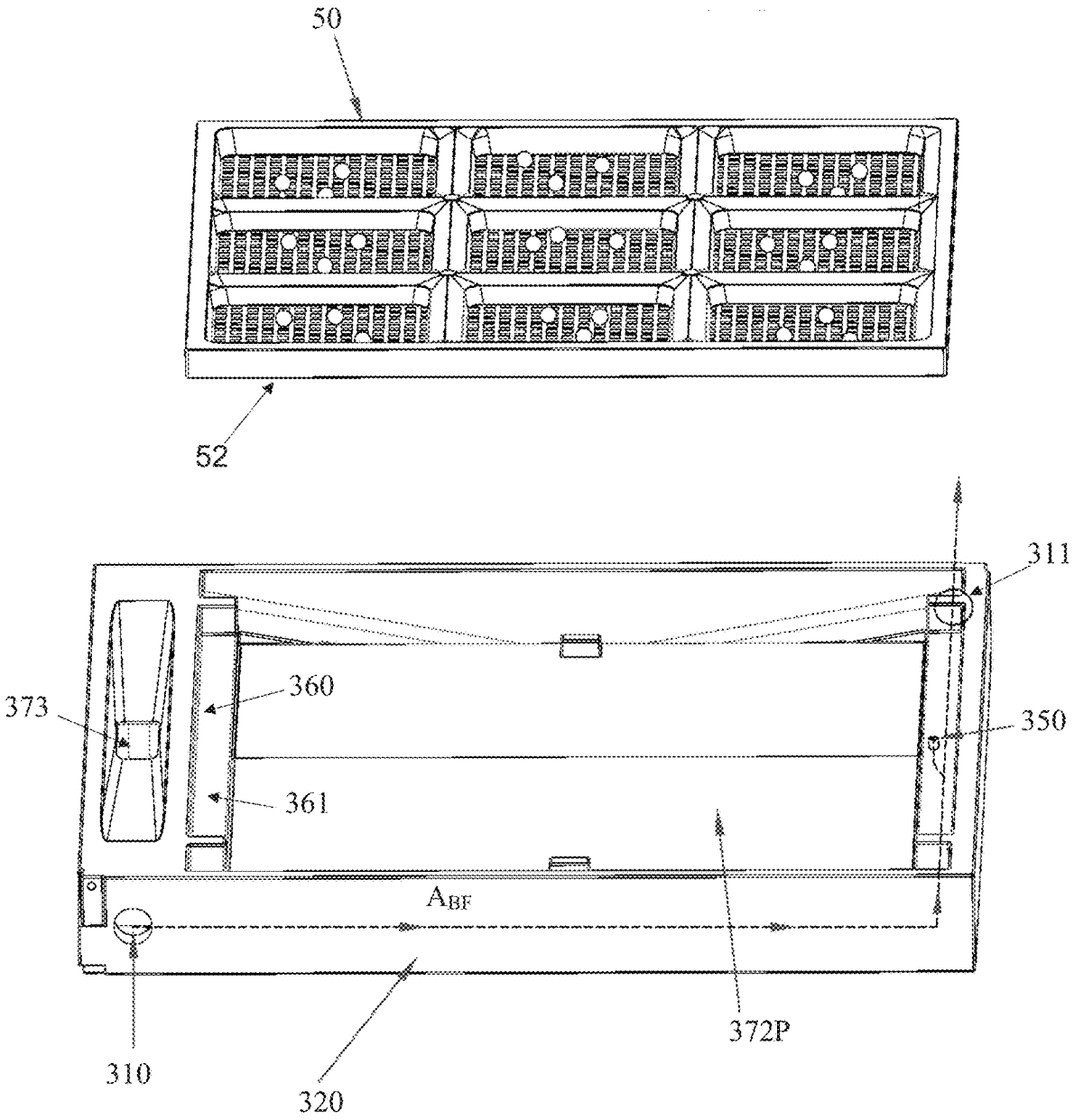
FIG. 9 is an illustration of the sifter box according to one preferred embodiment of the present invention receiving a screen insert made in a conventional manner.

In a further preferred embodiment, the sifter box 300 of the present invention may be used with a conventional screen insert, shown generally by reference numeral 50 in FIG. 9. In this case, the conventional screen insert 50 could have a conventional insert frame 52 made from wood, and, the conventional screen insert 50 may hold a screening media 600 (not shown in FIG. 9 for clarity) as is currently known in the art. The conventional screen insert frame 52 could then be received by the sifter box frame 320. In this case, the box/screen air outtake 350 of the sifter box 300 would be closed or blocked to prevent air escaping therefrom. In some cases, the conventional insert frame 52, when received by the sifter box 320, may rest against the box/screen air outtake 350 to create a fluid seal preventing unwanted leakage of air from the box frame air channel 330. Accordingly, the sifter box 300 of the present invention is reversibly compatible with conventional screen inserts 50 having conventional screen insert frames 52, which could be made from wood, or other materials, and, in any event, such conventional screen inserts 50 would not have an air channel for the passage of air therein. In such cases, air passing through the box frame air channel 330 would cool the sifter box 300 and the associated screening media 600 which is held by the conventional screen insert 50.

In a still further non-limiting preferred embodiment, as illustrated in FIG. 10, the screening media 600 may be attached directly to the sifter box 300. In this embodiment, there is no screen insert 500. In this case, air passing through the box frame air channel 330 cools the sifter box 300 and the associated screening media 600, which in this embodiment may be attached directly to the sifter box frame 320. This is an alternate non-limiting preferred embodiment which avoids the additional component of the screen insert 500 or conventional screen insert 50. While not shown, the sifter box 300 in this embodiment could also comprise a plurality of sifter box air channel holes (not shown) for directing air towards the screening media 600.

While the sifting device 144 is shown in FIG. 1 being used as part of a reducing apparatus 100, it is understood that the sifting device 144 may be used on its own or in association with other types of apparatuses or machines (not shown). It is accordingly understood that the sifting device 144 could be used in any application or manner where the separation of the particles according to size and/or shape is required or desired.

It is understood that this invention has been described from the perspective of air passing through the box frame air channel 300 and insert frame air channel 530. It is understood that the air could be at ambient or room temperature. However, it is understood that the air could also be at a temperature lower than room temperature, such as if the air has been cooled or emanates from an external location which is cooler, such as in northern climates. Furthermore, reference to air does not necessarily refer solely to breathable air but could also include nitrogen or other types of gases which may not comprise oxygen, including noble gases, if the material being sifted has a particular characteristic which causes the use of oxygen or nitrogen to be undesirable or dangerous. In alternate embodiments, the air could also be at an elevated temperature, such as emanating from a heater, or from a warmer external location, in cases where an elevated temperature of air above room temperature is desired depending on the specific application and the material to be sifted.

It is also understood that the material to be sifted can be any type of material where screening medias 600 may be used in order to separate materials based on size and/or shape. Furthermore, it is understood that the screening medias 600 may not necessarily have square openings but may be oval, round, or made from overlapping meshes as may be known in the art. In other words, the screening media 600 can be any type of element that may be used to separate material based on size, shape, or other similar characteristics. Furthermore, the material used to build the sifter box frame 320, the insert frame 520 and the screening media 600 could also be better selected for the particular input material 11. For instance, food grade plastic may be selected for the insert frame 520 and box frame 320 if the input material 11 comprises food or similar material.

Furthermore, it is understood that the material to be separated by the sifting device 144 can be any type of material, including plastics, food items, spices, powders, etc., and are not limited to specific types of material. Moreover, the materials could be any type of solid material of a particular size or shape. Furthermore, it is understood that the other characteristics of the sifting device 144, such as including the type of screening medias 600, the sifter box 300, insert frame 500 and the air passing through the frame air channels 330,530, may change accordingly depending on the material being sifted.

To the extent that a patentee may act as its own lexicographer under applicable law, it is hereby further directed that all words appearing in the claims section, except for the above defined words, shall take on their ordinary, plain and accustomed meanings (as generally evidenced, inter alia, by dictionaries and/or technical lexicons), and shall not be considered to be specially defined in this specification. Notwithstanding this limitation on the inference of "special definitions," the specification may be used to evidence the appropriate, ordinary, plain and accustomed meanings (as generally evidenced, inter alia, by dictionaries and/or technical lexicons), in the situation where a word or term used in the claims has more than one pre-established meaning and the specification is helpful in choosing between the alternatives.

It will be understood that, although various features of the invention have been described with respect to one or another of the embodiments of the invention, the various features and embodiments of the invention may be combined or used in conjunction with other features and embodiments of the invention as described and illustrated herein.

Although this disclosure has described and illustrated certain preferred embodiments of the invention, it is to be understood that the invention is not restricted to these particular embodiments. Rather, the invention includes all embodiments, which are functional, electrical or mechanical equivalents of the specific embodiments and features that have been described and illustrated herein.

The embodiments of the invention in which an exclusive property or privilege is claimed are defined as follows:

1. A sifting device to separate finished material from non-finished material, said sifting device comprising:

a screening media having a plurality of openings for separating finished material from non-finished material;

a sifter box associated with the screening media, said sifter box having a sifter box frame;

a box frame air channel located within the sifter box frame, said box frame air channel having a box air inlet for receiving air therein and a box air outlet for expelling air that has passed through at least a portion of the box frame air channel;

wherein air passing through the box frame air channel cools the sifter box and the associated screening media.

2. The sifting device as defined in claim 1 wherein the sifter box is manufactured from plastic and the screening media is manufactured from metal.

3. The sifting device as defined in claim 1 further comprising a screen insert for holding the screening media, said screen insert having an insert frame sized and shaped to be received by the sifter box frame.

4. The sifting device as defined in claim 3 further comprising an insert frame air channel located within the insert frame, said insert frame air channel having an insert frame air intake for receiving air to pass through at least a portion of the insert frame air channel;

wherein, when the insert frame is received by the sifter box, the insert frame air intake is in fluid communication with the box frame air channel for communicating air from the box frame air channel, to the insert frame air channel through the insert frame air intake.

5. The sifting device as defined in claim 4 wherein the insert frame air channel has a screen/channel interface wall to which the screening media is affixed, said screen/channel interface wall having increased thermal conductivity.

6. The sifting device as defined in claim 4 wherein the insert frame comprises a plurality of channel holes in fluid communication with the insert frame air channel to permit air to pass from the insert frame air channel to the screening media.

7. The sifting device as defined in claim 6 wherein the plurality of channel holes are oriented to direct air to a screening surface of the associated screening media; and wherein air passing through the plurality of channel holes from the insert frame air channel to the screening surface of the screening media cools the screening media.

8. The sifting device as defined in claim 6 wherein the plurality of channel holes are oriented on a slanted wall of the insert frame, said slanted wall being at an acute angle to the screening surface of the screening media to direct the air emanating from the plurality of channel holes towards the screening surface of the screening media being held by the screen insert.

9. The sifting device as defined in claim 4 wherein the insert frame is made from plastic and the screening media is made from metal.

10. The sifting device as defined in claim 1 further comprising an adjacent sifter box associated with an adjacent screening media, said adjacent sifter box having an adjacent sifter box frame and an adjacent sifter box air channel located within the adjacent sifter box frame, said adjacent box frame air channel having an adjacent box air inlet for receiving air therein and an adjacent box air outlet for expelling air that has passed through at least a portion of the adjacent box frame air channel;

wherein the sifter box is located adjacent to the adjacent sifter box in the sifting device, and the box air outlet of the box frame air channel is fluidly connected to the adjacent box air inlet of the adjacent box frame air channel.

11. The sifting device as defined in claim 10 wherein the box air inlet is located diagonally opposed from the box air outlet;

wherein the adjacent box air inlet is located diagonally opposed from the adjacent air outlet; and wherein the sifter box and adjacent sifter box are arranged in stacked relationship with the sifter box rotated about 180 degrees with respect to the adjacent sifter box so that the box air outlet is located near the adjacent box air inlet.

12. The sifting device as defined in claim 10 wherein the plurality of openings of the screening media are sized to permit passage of finished material and prevent passage of non-finished material and wherein the sifter box comprises a non-finished particle flow path to direct material which has not passed through any screening media to the adjacent screening media associated with the adjacent sifter box, and a finished particle flow path to direct material which has passed through the screening media to a finished particle output.

13. The sifting device as defined in claim 10 further comprising:

an input for receiving input material to be separated:

two or more adjacent sifter boxes arranged in stacked relationship with the sifter box, each adjacent sifter box receiving air from the adjacent box air outlet of the adjacent box frame air channel of the preceding adjacent sifter box;

a finished particle output for the finished material that has passed through one of the screening media or the adjacent screening media to exit; and a non-finished particle output for the material that has not passed through one of the screening media or adjacent media to exit.

14. A sifter box for use in a sifting device, said sifting device separating finished material from non-finished material, said sifter box comprising:

a sifter box frame associated with a screening media for separating finished material from non-finished material;

a box frame air channel located within the box frame, said box frame air channel having a box air inlet for receiving air therein and a box air outlet for expelling air that has passed through at least a portion of the box frame air channel;

wherein the passage of air through the box frame air channel cools the sifter box.

15. The sifter box as defined in claim 14 wherein the screening media is affixed to an insert frame of a screen insert, and the sifter box frame is sized and shaped to receive the insert frame; and wherein air passing through the box frame air channel cools the screen insert and the associated screening medium.

16. The sifter box as defined in claim 15 further comprising a box/screen air outtake to fluidly connect to a corresponding insert frame air intake associated with the insert frame when the insert frame is received by the sifter box frame;

wherein the box/screen air outtake permits a portion of the air passing in the box frame air channel to flow into the insert frame air intake and pass through at least a portion of an insert frame air channel located within the insert frame.

17. The sifter box as defined in claim 16 wherein the sifter box frame comprises a screen insert seat for receiving the insert frame, said screen insert seat having a flange for engaging a portion of the insert frame.

18. The sifter box as defined in claim 17 wherein the box/screen air outtake is located on the flange of the screen insert seat, and wherein, when the portion of the insert frame engages the box sifter insert seat, the box/screen air outtake is fluidly connected to the corresponding insert frame air intake of the associated insert frame.

19. A screen insert for use with a sifter box of a sifting device, said sifting device separating finished material from non-finished material, said screen insert comprising:

an insert frame sized and shaped to be received by a sifter box frame of the sifter box;

a screening media affixed to the insert frame, the screening media having a plurality of openings sized to permit passage of finished material and prevent passage of non-finished material;

an insert frame air channel located within the insert frame, said insert frame air channel having an insert frame air intake for receiving air therein, said air passing through at least a portion of the insert frame air channel;

wherein the passage of air through the insert frame air channel causes heat transfer between the air and the screening media affixed to the insert frame.

20. The screen insert as defined in claim 19 further comprising a plurality of channel holes in fluid communication with the insert frame air channel to permit air to pass from the insert frame air channel to the screening media.

21. The screen insert as defined in claim 20 wherein the plurality of channel holes are oriented to direct air to a screening surface of the screening media affixed to the insert frame; and wherein air passing through the plurality of channel holes from the insert frame air channel to the screening surface of the screening media cools the screening media.

22. The screen insert as defined in claim 20 wherein the plurality of channel holes are oriented on a slanted wall of the insert frame, said slanted wall being at an acute angle to a screening surface of the screening media to direct the air emanating from the plurality of channel holes towards the screening surface of the screening media affixed to the insert frame.

23. The screen insert as defined in claim 21 wherein air passing through the plurality of channel holes from the insert frame air channel and directed to the screening surface of the screening media cools the finished material and non-finished material being separated on the screening surface of the screening media, and facilitates movement of the finished material and the non-finished material on the screening surface of the screening media.

24. The screen insert as defined in claim 19 wherein, when the insert frame is received by the sifter box frame, the insert air intake is fluidly connected to a corresponding box/screen air outtake associated with the sifter box frame; and wherein the corresponding box/screen air outtake permits a portion of the air passing in a box frame air channel of the sifter box to flow into the insert frame air channel through the insert air intake.

25. The screen insert as defined in claim 20 wherein the insert frame is made from plastic and the screening media is made from metal.

26. The sifting device as defined in claim 1 wherein the screening media is affixed to the associated sifter box.

27. The sifter box as defined in claim 14 wherein the screening media is affixed to the sifter box.

28. The sifting device as defined in claim 4 further comprising a box/screen air outtake to fluidly connect to the insert frame air intake associated with the insert frame when the insert frame is received by the sifter box frame;

wherein the box/screen air outtake permits a portion of the air passing in the box frame air channel to flow into the insert frame air intake and pass through at least a portion of the insert frame air channel located within the insert frame.

29. The sifting device as defined in claim 28 wherein the sifter box frame comprises a screen insert seat for receiving the insert frame, said screen insert seat having a flange for engaging a portion of the insert frame, said box/screen air outtake being located on the flange of the screen insert seat; and wherein, when the portion of the insert frame engages the box sifter insert seat, the box/screen air outtake is fluidly connected to the corresponding insert frame air intake of the insert frame.

* * * * *